US007566272B2

(12) United States Patent
Gerrard et al.

(10) Patent No.: US 7,566,272 B2
(45) **Date of Patent: *Jul. 28, 2009**

(54) GAMING DEVICE WITH OFFER/ACCEPTANCE GAME HAVING OFFER CHOSEN FROM MULTIPLE FORMED OFFERS

(75) Inventors: Peter Gerrard, England (GB); Michael Evans, Cheshire (GB); Dov L. Randall, Las Vegas, NV (US); Aaron T. Jones, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/853,603

(22) Filed: Sep. 11, 2007

(65) Prior Publication Data

US 2007/0298872 A1 Dec. 27, 2007

Related U.S. Application Data

(63) Continuation of application No. 10/659,689, filed on Sep. 9, 2003, now Pat. No. 7,270,604.

(51) Int. Cl.
*A63F 9/24* (2006.01)

(52) U.S. Cl. ..... 463/25

(58) Field of Classification Search ..... 463/16, 463/20, 25

See application file for complete search history.

(56) References Cited

U.S. PATENT DOCUMENTS 4,448,419 A 5/1984 Telnaes
4,582,324 A 4/1986 Koza et al.
4,624,459 A 11/1986 Kaufman
4,695,053 A 9/1987 Vazquez, Jr. et al.
4,991,848 A 2/1991 Greenwood et al.
5,178,390 A 1/1993 Okada (Continued)

FOREIGN PATENT DOCUMENTS

EP 0874337 A1 10/1998

(Continued)

OTHER PUBLICATIONS

A Vamp for All Seasons Article, written by Strictly Slots, published in 2002.

(Continued)

*Primary Examiner*—Peter DungBa Vo
*Assistant Examiner*—Jasson H Yoo
(74) *Attorney, Agent, or Firm*—K&L Gates LLP

(57) ABSTRACT

A primary or secondary game for a gaming device. In one embodiment, the player is provided up to three picks, i.e., picks three contestants. The first two contestants both form potential award offers. The game then provides the greater of the two potential award offers to the player as an initial offer. This initial sequence alternatives includes more than two picks, contestants and potential offers. The offer acceptance feature arises after the initial offer. The player must decide whether to keep the initial offer or forego that offer for a final offer. If the player keeps the offer the game provides that initial offer to the player and ends if the player rejects that initial offer, the game proceeds to build a third and final offer, which is then provided to the player automatically.

19 Claims, 17 Drawing Sheets

U.S. PATENT DOCUMENTS

| | | | | |
|---|---|---|---|---|
| 5,205,555 | A | 4/1993 | Hamano | |
| 5,342,047 | A | 8/1994 | Heidel et al. | |
| 5,456,465 | A | 10/1995 | Durham | |
| 5,524,888 | A | 6/1996 | Heidel | |
| 5,536,016 | A | 7/1996 | Thompson | |
| 5,542,669 | A | 8/1996 | Charron et al. | |
| 5,560,603 | A | 10/1996 | Seelig et al. | |
| 5,611,535 | A | 3/1997 | Tiberio | |
| 5,711,525 | A | 1/1998 | Breeding | |
| 5,769,716 | A | 6/1998 | Saffari et al. | |
| 5,772,509 | A | 6/1998 | Weiss | |
| 5,775,692 | A | 7/1998 | Watts et al. | |
| 5,788,573 | A | 8/1998 | Baerlocher et al. | |
| 5,816,918 | A | 10/1998 | Kelly et al. | |
| 5,823,874 | A | 10/1998 | Adams | |
| 5,833,538 | A | 11/1998 | Weiss | |
| 5,848,932 | A | 12/1998 | Adams | |
| 5,851,148 | A | 12/1998 | Brune et al. | |
| 5,873,781 | A | 2/1999 | Keane | |
| 5,882,261 | A | 3/1999 | Adams | |
| 5,902,184 | A | 5/1999 | Bennett | |
| 5,911,418 | A | 6/1999 | Adams | |
| 5,947,820 | A | 9/1999 | Morro et al. | |
| 5,951,397 | A | 9/1999 | Dickinson | |
| 5,964,463 | A | 10/1999 | Moore, Jr. | |
| 5,967,894 | A | 10/1999 | Kinoshita et al. | |
| 5,980,384 | A | 11/1999 | Barrie | |
| 5,984,781 | A | 11/1999 | Sunaga | |
| 5,997,400 | A | 12/1999 | Seelig et al. | |
| 5,997,401 | A | 12/1999 | Crawford | |
| 6,004,207 | A | 12/1999 | Wilson, Jr. et al. | |
| 6,015,346 | A | 1/2000 | Bennett | |
| 6,016,338 | A | 1/2000 | Bansal et al. | |
| 6,019,369 | A | 2/2000 | Nakagawa et al. | |
| 6,033,307 | A | 3/2000 | Vancura | |
| 6,056,642 | A | 5/2000 | Bennett | |
| 6,059,289 | A | 5/2000 | Vancura | |
| 6,059,658 | A | 5/2000 | Mangano et al. | |
| 6,062,980 | A | 5/2000 | Luciano | |
| 6,068,552 | A * | 5/2000 | Walker et al. | 463/21 |
| 6,089,976 | A | 7/2000 | Schneider et al. | |
| 6,089,977 | A | 7/2000 | Bennett | |
| 6,089,978 | A | 7/2000 | Adams | |
| 6,093,102 | A | 7/2000 | Bennett | |
| 6,102,798 | A | 8/2000 | Bennett | |
| 6,120,031 | A | 9/2000 | Adams | |
| 6,126,541 | A | 10/2000 | Fuchs | |
| 6,126,542 | A | 10/2000 | Fier | |
| 6,142,873 | A | 11/2000 | Weiss et al. | |
| 6,142,874 | A | 11/2000 | Kodachi et al. | |
| 6,142,875 | A | 11/2000 | Kodachi et al. | |
| 6,146,273 | A | 11/2000 | Olsen | |
| 6,159,095 | A | 12/2000 | Frohm et al. | |
| 6,159,096 | A | 12/2000 | Yoseloff | |
| 6,159,097 | A | 12/2000 | Gura | |
| 6,159,098 | A | 12/2000 | Slomiany et al. | |
| 6,162,121 | A | 12/2000 | Morro et al. | |
| 6,168,520 | B1 | 1/2001 | Baerlocher et al. | |
| 6,168,523 | B1 | 1/2001 | Piechowiak et al. | |
| 6,173,955 | B1 | 1/2001 | Perrie et al. | |
| 6,174,233 | B1 | 1/2001 | Sunaga et al. | |
| 6,174,235 | B1 | 1/2001 | Walker et al. | |
| 6,190,254 | B1 | 2/2001 | Bennett | |
| 6,190,255 | B1 | 2/2001 | Thomas et al. | |
| 6,203,429 | B1 | 3/2001 | Demar et al. | |
| 6,210,279 | B1 | 4/2001 | Dickinson | |
| 6,213,876 | B1 | 4/2001 | Moore, Jr. | |
| 6,224,483 | B1 | 5/2001 | Mayeroff | |
| 6,231,442 | B1 | 5/2001 | Mayeroff | |
| 6,231,445 | B1 | 5/2001 | Acres | |
| 6,261,177 | B1 | 7/2001 | Bennett | |
| 6,302,790 | B1 | 10/2001 | Brossard | |
| 6,305,686 | B1 | 10/2001 | Perrie et al. | |
| 6,309,300 | B1 | 10/2001 | Glavich | |
| 6,312,334 | B1 | 11/2001 | Yoseloff | |
| 6,328,649 | B1 | 12/2001 | Randall et al. | |
| 6,375,187 | B1 * | 4/2002 | Baerlocher | 273/143 R |
| 6,398,218 | B1 | 6/2002 | Vancura | |
| 6,413,160 | B1 | 7/2002 | Vancura | |
| 6,413,161 | B1 | 7/2002 | Baerlocher et al. | |
| 6,435,511 | B1 | 8/2002 | Vancura et al. | |
| 6,439,995 | B1 | 8/2002 | Hughs-Baird et al. | |
| 6,461,241 | B1 | 10/2002 | Webb et al. | |
| 6,464,582 | B1 | 10/2002 | Baerlocher et al. | |
| 6,471,208 | B2 | 10/2002 | Yoseloff et al. | |
| 6,485,367 | B1 * | 11/2002 | Joshi | 463/13 |
| 6,494,785 | B1 | 12/2002 | Gerrard et al. | |
| 6,506,118 | B1 | 1/2003 | Baerlocher et al. | |
| 6,514,141 | B1 | 2/2003 | Kaminkow et al. | |
| 6,561,899 | B2 | 5/2003 | Vancura | |
| 6,569,015 | B1 | 5/2003 | Baerlocher et al. | |
| 6,575,830 | B2 | 6/2003 | Baerlocher et al. | |
| 6,585,591 | B1 | 7/2003 | Baerlocher et al. | |
| 6,595,854 | B2 | 7/2003 | Hughs-Baird et al. | |
| 6,599,192 | B1 | 7/2003 | Baerlocher et al. | |
| 6,620,045 | B2 | 9/2003 | Berman et al. | |
| 6,632,141 | B2 | 10/2003 | Webb et al. | |
| 6,648,754 | B2 | 11/2003 | Baerlocher et al. | |
| 6,659,864 | B2 | 12/2003 | McGahn et al. | |
| 6,692,355 | B2 | 2/2004 | Baerlocher et al. | |
| 6,719,632 | B2 | 4/2004 | Palmer et al. | |
| 6,722,981 | B2 | 4/2004 | Kaminkow et al. | |
| 6,722,982 | B2 | 4/2004 | Kaminkow et al. | |
| 6,758,750 | B2 | 7/2004 | Baerlocher et al. | |
| 6,786,820 | B2 | 9/2004 | Gerrard et al. | |
| 6,793,579 | B2 | 9/2004 | Baerlocher et al. | |
| 6,796,905 | B2 | 9/2004 | Baerlocher et al. | |
| 6,808,452 | B2 | 10/2004 | Baerlocher et al. | |
| 6,808,454 | B2 | 10/2004 | Gerrard et al. | |
| 6,811,483 | B1 | 11/2004 | Webb et al. | |
| 6,852,030 | B2 | 2/2005 | Baerlocher et al. | |
| 6,890,257 | B2 | 5/2005 | Baerlocher | |
| 6,899,623 | B2 | 5/2005 | Baerlocher | |
| 6,942,566 | B2 | 9/2005 | Baerlocher et al. | |
| 6,942,567 | B2 | 9/2005 | Baerlocher et al. | |
| 6,960,132 | B2 | 11/2005 | Baerlocher et al. | |
| 6,966,833 | B2 | 11/2005 | Kaminkow et al. | |
| 6,971,953 | B2 | 12/2005 | Gerrard et al. | |
| 7,001,273 | B2 | 2/2006 | Baerlocher | |
| 2002/0042294 | A1 * | 4/2002 | Pau et al. | 463/16 |
| 2002/0045475 | A1 | 4/2002 | Glavich et al. | |
| 2002/0052232 | A1 | 5/2002 | Kaminkow | |
| 2002/0072402 | A1 | 6/2002 | Baerlocher | |
| 2002/0142822 | A1 | 10/2002 | Baerlocher et al. | |
| 2002/0151350 | A1 | 10/2002 | Baerlocher et al. | |
| 2002/0155883 | A1 | 10/2002 | Baerlocher | |
| 2002/0187827 | A1 | 12/2002 | Blankstein | |
| 2003/0013514 | A1 | 1/2003 | Cregan et al. | |
| 2003/0040355 | A1 | 2/2003 | Baerlocher | |
| 2003/0040360 | A1 | 2/2003 | Kaminkow | |
| 2003/0045344 | A1 | 3/2003 | Webb et al. | |
| 2003/0045348 | A1 | 3/2003 | Palmer et al. | |
| 2003/0045350 | A1 | 3/2003 | Baerlocher et al. | |
| 2003/0060260 | A1 | 3/2003 | Gerrard et al. | |
| 2003/0064795 | A1 | 4/2003 | Baerlocher et al. | |
| 2003/0078093 | A1 | 4/2003 | Simms et al. | |
| 2003/0087693 | A1 | 5/2003 | Baerlocher et al. | |
| 2003/0157982 | A1 | 8/2003 | Gerrard et al. | |
| 2003/0162584 | A1 | 8/2003 | Hughs-Baird et al. | |
| 2004/0009805 | A1 | 1/2004 | Baerlocher et al. | |
| 2004/0023707 | A1 | 2/2004 | Maya et al. | |
| 2004/0038729 | A1 | 2/2004 | Webb et al. | |
| 2004/0106444 | A1 | 6/2004 | Cuddy et al. | |
| 2004/0162128 | A1 | 8/2004 | Baerlocher et al. | |

| | | | |
|---|---|---|---|
| 2004/0180710 | A1 | 9/2004 | Palmer et al. |
| 2004/0185928 | A1 | 9/2004 | Baerlocher et al. |
| 2004/0214632 | A1 | 10/2004 | Cuddy et al. |
| 2005/0020346 | A1 | 1/2005 | Baerlocher |
| 2005/0032567 | A1 | 2/2005 | Baerlocher et al. |
| 2005/0037829 | A1 | 2/2005 | Baerlocher et al. |
| 2005/0049036 | A1 | 3/2005 | Mead |
| 2005/0054413 | A1 | 3/2005 | Randall et al. |
| 2005/0101375 | A1 | 5/2005 | Webb et al. |
| 2005/0130729 | A1 | 6/2005 | Baerlocher et al. |
| 2005/0187010 | A1 | 8/2005 | Baerlocher |
| 2005/0266914 | A1 | 12/2005 | Baerlocher et al. |
| 2006/0003837 | A1 | 1/2006 | Baerlocher et al. |

FOREIGN PATENT DOCUMENTS

| | | | |
|---|---|---|---|
| EP | 0926645 | A2 | 6/1999 |
| EP | 0944030 | A2 | 9/1999 |
| EP | 0945837 | A2 | 9/1999 |
| EP | 0981119 | A2 | 2/2000 |
| EP | 0984408 | A2 | 3/2000 |
| EP | 0984409 | A2 | 3/2000 |
| WO | WO 9732285 | | 9/1997 |
| WO | WO 00/12186 | | 3/2000 |

OTHER PUBLICATIONS

Addams Family Article, written by Strictly Slots, published in 2000.
American Bandstand Article, written by Strictly Slots, published in 2002.
By George Advertisement, written by IGT, published in 2002.
Cash for Life—Offer Bonus Advertisement/Lotsa Loot Advertisement/Take It or Leave It Advertisement, written by Bally Gaming, published in 2002.
Cash for Life—Triple Spin Bonus Article, written by Strictly Slots, published in 2003.
Deep Pockets Advertisement, written by IGT, published in 2002.
Deep Pockets Article, written by Strictly Slots, published in 2002.
Double Top Dollar Advertisement, written by IGT, published in 2003.
Fire and Fortune Article, written by Strictly Slots, published in 2001.
Hollywood Advertisement, written by Shuffle Master Gaming, published in 2001.
Jeopardy Advertisements, written by IGT, published in 2000.
King Cash Slots Advertisement, written by IGT, published in 2003.
Let's Make A Deal Advertisements written by Bally Gaming/Shuffle Master Gaming, published in 2001.
Let's Make A Deal tv tome [online], [retrieved on Jan. 15, 2004], Retrievd from the Internet:<URL: http:/www.tvtome.com/tvtome/servlet/showmainservlet/showed; 5457/>, pp. 1-5.
Let's Make A Deal, [online], [retrieved on Jan. 9, 2006], retrieved from the Internet:< URL: http://www.curalliaume.com/1mad.html>, pp. 1-14.
Let's Make A Deal, [online], [retrieved on Jan. 9, 2006], retrieved from the Internet:< URL: http://www.en.wikipedia.org/wiki/Let's_Make_a_Deal>, pp. 1-14.
Press Your Luck Advertisement, written by Shuffle Master Gaming, published in 2000.
Press Your Luck Article, written by Strictly Slots, published in 2000.
Press Your Luck [online], last modified Jan. 3, 2006, [retrieved on Jan. 5, 2006]. Retrieved from the internet:<URL: http://en.wikipedia.org/wiki/Press_Your_Luck . pp. 1-5.
Price is Right—Cliff Hangers Advertisement, written by IGT, published in 2001.
Price is Right—Cliff Hangers Description, printed from www.geocities.com (web site) on Mar. 21, 2001.
Price is Right—Showcases Description, printed from schuminweb.com (web site) on Mar. 16, 2001.
Psycho Cash Beast Advertisement, written by IGT, published in 1999.
Richard Lehman, Slot Operations The Myth and the Math, 2002, published by the Institute for the study of Gambling and Commercial Gaming.
Take Your Pick Advertisement, written by IGT/Anchor Gaming, published in 1999.
Take Your Pick Article, written by Strictly Slots, published in Mar. 2001.
The "Jeopardy!" Home Game Home page [online], [retrieved on Jan. 6, 2006], retrieved from the internet:<URL:http://userdata.acd.net/ottinger/inside/jeopardy/> pp. 1-6.
Three Wishes Article, written by Strictly Slots, published in 2000.
Top Dollar Game Advertisement, written by IGT, published in 1998.

* cited by examiner

FIG. 9

150

14

| PICKS OF CONTESTANTS | # OF VALUES RANGE | AVERAGE NUMBER OF VALUES | AVERAGE VALUE AMOUNT | EXPECTED VALUE |
|---|---|---|---|---|
| FIRST | 2 TO 10 | 6 | 9 | 54 |
| SECOND | 2 TO 8 | 5 | 10.8 | 54 |
| THIRD | 1 TO 5 | 3 | 18 | 54 |

FIG. 10

155

2 - 5%
3 - 10%
4 - 10%
5 - 15%
6 - 20%
7 - 15%
8 - 10%
9 - 10%
10 - 5%

14

FIG. 11

160

100 - 35%
200 - 25%
300 - 20%
400 - 15%
500 - 5%

14

FIG. 12

165

LEVEL 1 - 50%
LEVEL 2 - 30%
LEVEL 3 - 10%
LEVEL 4 - 8%
LEVEL 5 - 2%

14

FIG. 17

14

300

| | 74a A | 74b B | 74c C | 74d D | 74e E | 74f F | VALUE |
|---|---|---|---|---|---|---|---|
| 72a 50% | B-HIT | B-HIT | B-MISS | B-HIT | B-MISS | B-HIT | 5 |
| 72b 40% | B-MISS | B-HIT | | B-HIT | | B-MISS | 10 |
| 72c 30% | | B-MISS | | B-HIT | | | 20 |
| 72d 20% | | | | B-HIT | | | 50 |
| 72e 10% | | | | B-MISS | | | 100 |
| 72f 40% | | | | | | | 500 |

CONTESTANT- TOTAL 110

FIG. 18

14

| | 74a A | 74b B | 74c C | 74d D | 74e E | 74f F | VALUE |
|---|---|---|---|---|---|---|---|
| 72a 50% | 5 TO B | 5 TO B | A-MISS | 5 TO B | A-HIT | 5 TO B | 5 |
| 72b 40% | A-HIT | 10 TO B | | 10 TO B | A-MISS | A-HIT | 10 |
| 72c 30% | A-MISS | A-HIT | | 20 TO B | | A-MISS | 20 |
| 72d 20% | | A-HIT | | 50 TO B | | | 50 |
| 72e 10% | | A-HIT | | A-MISS | | | 100 |
| 72f 40% | | A-MISS | | | | | 500 |

CONTESTANT B-TOTAL 110, CONTESTANT A-TOTAL 195 → OFFER 195

KEEP OR C

FIG. 19

14

300

| | 74a A | 74b B | 74c C | 74d D | 74e E | 74f F | VALUE |
|---|---|---|---|---|---|---|---|
| 72a 50% | 5 TO B | 5 TO B | C-HIT | 5 TO B | 5 TO A | 5 TO B | 5 |
| 72b 40% | 10 TO A | 10 TO B | C-MISS | 10 TO B | C-HIT | 10 TO A | 10 |
| 72c 30% | C-MISS | 20 TO A | | 20 TO B | C-MISS | C-MISS | 20 |
| 72d 20% | | 50 TO A | | 50 TO B | | | 50 |
| 72e 10% | | 100 TO A | | C-MISS | | | 100 |
| 72f 40% | | C-HIT | | | | | 500 |

REJECTED OFFER 195, CONTESTANT C GETS 515

FIG. 20

16,18

| | 74a A | 74b B | 74c C | 74d D | 74e E | 74f F | VALUE |
|---|---|---|---|---|---|---|---|
| 72a 50% | 5 TO B | 5 TO B | 5 TO C | 5 TO B | 5 TO A | 5 TO B | 5 |
| 72b 40% | 10 TO A | 10 TO B | | 10 TO B | 10 TO C | 10 TO A | 10 |
| 72c 30% | | 20 TO A | | 20 TO B | | | 20 |
| 72d 20% | | 50 TO A | | 50 TO B | | | 50 |
| 72e 10% | | 100 TO A | | | | | 100 |
| 72f 40% | | 500 TO C | | | | | 500 |

PLAYER'S AWARD 515

FIG. 21

14

300

| | A (74a) | B (74b) | C (74c) | D (74d) | E (74e) | F (74f) | VALUE |
|---|---|---|---|---|---|---|---|
| 72a 50% | 5 TO B | 5 TO B | C-HIT | 5 TO B | 5 TO A | 5 TO B | 5 |
| 72b 40% | 10 TO A | 10 TO B | | 10 TO B | C-MISS | 10 TO A | 10 |
| 72c 30% | C-MISS | 20 TO A | | 20 TO B | | C-MISS | 20 |
| 72d 20% | | 50 TO A | | 50 TO B | | | 50 |
| 72e 10% | | 100 TO A | | C-MISS | | | 100 |
| 72f 40% | | C-MISS | | | | | 500 |

REJECTED OFFER 195, CONTESTANT C GETS 5, WAIT THERE'S MORE

FIG. 22

14

| | A (74a) | B (74b) | C (74c) | D (74d) | E (74e) | F (74f) | VALUE |
|---|---|---|---|---|---|---|---|
| 72a 50% | 5 TO B | 5 TO B | C-HIT | 5 TO B | 5 TO A | 5 TO B | 5 |
| 72b 40% | 10 TO A | 10 TO B | C-MISS | 10 TO B | C-HIT | 10 TO A | 10 |
| 72c 30% | C-MISS | 20 TO A | | C-MISS | C-HIT | | 20 |
| 72d 20% | | 50 TO A | | | C-HIT | | 50 |
| 72e 10% | | 100 TO A | | | C-MISS | | 100 |
| 72f 40% | | C-MISS | | | | | 500 |

REJECTED OFFER 195, CONTESTANT C GETS 85 ON EXTRA PASS

FIG. 23

16,18

300

| | A (74a) | B (74b) | C (74c) | D (74d) | E (74e) | F (74f) | VALUE |
|---|---|---|---|---|---|---|---|
| 72a 50% | 5 TO B | 5 TO B | 5 TO C | 5 TO B | 5 TO A | 5 TO B | 5 |
| 72b 40% | 10 TO A | 10 TO B | | 10 TO B | 10 TO C | 10 TO A | 10 |
| 72c 30% | | | | | 20 TO C | | 20 |
| 72d 20% | | | | | 50 TO C | | 50 |
| 72e 10% | | | | | | | 100 |
| 72f 40% | | | | | | | 500 |

PLAYER'S AWARD 85

FIG. 24

14

| | A (74a) | B (74b) | C (74c) | D (74d) | E (74e) | F (74f) | VALUE |
|---|---|---|---|---|---|---|---|
| 72a 50% | B-HIT | B-HIT | B-HIT | B-HIT | B-MISS | B-HIT | 5 |
| 72b 40% | B-HIT | B-HIT | B-MISS | B-HIT | | B-HIT | 10 |
| 72c 30% | B-MISS | B-HIT | | B-HIT | | B-HIT | 20 |
| 72d 20% | | B-HIT | | B-HIT | | B-HIT | 50 |
| 72e 10% | | B-HIT | | B-HIT | | B-HIT | 100 |
| 72f 40% | | B-HIT | | B-HIT | | B-HIT | 500 |

CONTESTANT B - TOTAL 2075 - AUTO LOCK, PLAYER GETS 2075

GAMING DEVICE WITH OFFER/ACCEPTANCE GAME HAVING OFFER CHOSEN FROM MULTIPLE FORMED OFFERS

PRIORITY CLAIM

This application is a continuation patent application of U.S. patent application Ser. No. 10/659,689, filed on Sep. 9, 2003, the entire contents of which is incorporated herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates to wagering gaming devices and more particularly, the present invention relates to an offer/acceptance game.

Gaming devices provide enjoyment and excitement to players, in part, because they may ultimately lead to monetary awards for the players. Gaming devices also provide enjoyment and excitement to the players because they are fun to play. Secondary or bonus games, in particular, provide gaming device manufacturers with the opportunity to add enjoyment and excitement to that which is already expected from a primary or base game of the gaming device. Secondary or bonus games provide extra awards to the player and enable the player to play a game that is different than the primary or base game.

Gaming devices are typically games of luck, not skill. Primary games are set up to pay back a certain average percentage of the amount of money wagered. The average payout percentage in most primary games is set high enough that any player who plays a few hands or spins of the reels will win. That is, in most primary games, it is not too difficult to experience some level of success. Bonus games are typically set up for the player to succeed. The player usually wins an award in a bonus game. In bonus game play, the goal is often to maximize the possible award.

One known secondary game provides a player with a series of offers, where each offer includes a number of credits, coins, tokens or dollars. The player may accept or reject each offer prior to the final offer. The offers are randomly determined from a series of potential offers of differing values. If the player accepts an offer, the game provides the offer to the player. If the player rejects an offer, the gaming device provides another offer to the player, as long as the current offer is not the final offer. The player is automatically provided the final offer if the player has not previously accepted an offer. This type of gaming device has achieved significant popularity in the gaming industry.

As part of a continuing need to provide gaming devices that issue primary game and secondary game awards in an exciting and enjoyable manner, it is desirable to have variability in game play as well as variability in outcomes and potential payouts. This may be more or less possible depending on the type of machine and the desired winning percentage.

SUMMARY OF THE INVENTION

The present invention provides a gaming device. The gaming device employs both a method and apparatus for playing the offer and acceptance game of the present invention. The present invention is operable with multiple types of wagering games including slot, poker, keno and blackjack.

In one embodiment, the game of the present invention follows the theme of the popular Jeopardy™ game show. The game includes or displays a grid or board to the player having a plurality of columns and rows of values. The values increment in each column from a lowest value to a highest value. In one embodiment, the values across each row or at least some of the rows are constant. The game instructs the player to select a contestant from a plurality of contestants. After a player selects a contestant, the game generates a plurality of the values from the board for the player. Those values accumulate to form an offer for the player.

In one embodiment, the player is provided up to three picks, i.e., picks three contestants. The first two contestants each result in a potential award offer. The game offers the greater of the two potential award offers to the player as an initial offer. This initial sequence alternatively includes more than two picks, contestants and potential offers. The offer/acceptance feature arises after the initial offer. The player must decide whether to keep the initial offer or forego that offer for a final offer. If the player keeps the offer, the game provides that initial offer to the player and ends. If the player rejects that initial offer, the game proceeds to build a third and final offer, which is then provided to the player automatically.

In one preferred embodiment, the values are displayed in accordance with a Jeopardy™ game board. That is, for each column, the values are displayed from lowest to highest starting from the top. In one embodiment, the first value of a column that is generated does not have to be the lowest value in the column. Every subsequent value generated from that column, however, should be greater than the first value generated, to appear like the Jeopardy™ game. In certain instances described below, the rules concerning the display of values will conflict with methods used to generate values for the offers/potential offers. The present invention provides multiple methods and apparatuses for either avoiding the conflict or remedying the conflict once it occurs. In one preferred embodiment, a value from a first row must be selected before a value in the second row of the same column is selected, and so on. Here, the offers for the contestants build incrementally. If a row of values is filled, the values of that row can no longer be generated, avoiding any conflict between the value generations and the display rules.

In one preferred embodiment, the first, second and potentially the third contestant each pick from each of a provided number of columns. The values increase as the picks progress in the columns, but the likelihood of getting those higher values decrease, tending to even out the expected value of each contestant. In any column, a subsequent contestant begins where the previous contestant stopped, which can be the first selection, last selection or a middle selection in the column. Although in one embodiment, the selection analysis proceeds in a orderly manner, e.g., from left to right, the display of the picks for any contestant can be done randomly in different columns, making the game appear virtually exactly the same as the true Jeopardy™ game, and wherein each contestant, although picking at different value levels than for other contestants, has about the same expected value.

It is the player's hope that at least one of the offers is built using a value from the final, most lucrative row. Otherwise, the lower the rows, the higher the values and offers/potential offers. Different columns can be weighted differently to increase the chance of generating those weighted values.

It is therefore an advantage of the present invention to provide a gaming device with a fun and exciting display.

It is another advantage of the present invention to provide a gaming device with an intelligent display of values.

It is a further advantage of the present invention to provide a gaming device with an improved offer/acceptance type of game.

Additional features and advantages of the present invention are described in, and will be apparent from, the following Detailed Description of the Invention and the figures.

BRIEF DESCRIPTION OF THE FIGURES

FIG. 9 is a table stored in memory illustrating different ranges and amounts for the values used to form the offers/potential offers of the present invention.

FIG. 10 is a table stored in memory illustrating a weighted range of values used to form the offers/potential offers of the present invention.

FIG. 11 is a table stored in memory illustrating weighted values used to form the offers/potential offers of the present invention.

FIG. 12 is a table stored in memory illustrating weighted value levels used to generate the offers/potential offers of the present invention.

FIGS. 17, 18, 19, 20, 21, 22, 23 and 24 are elevation views of the display device illustrating one embodiment of the present invention for generating the values in accordance with a theme of the game.

DETAILED DESCRIPTION OF THE INVENTION

General

Figure 1A:
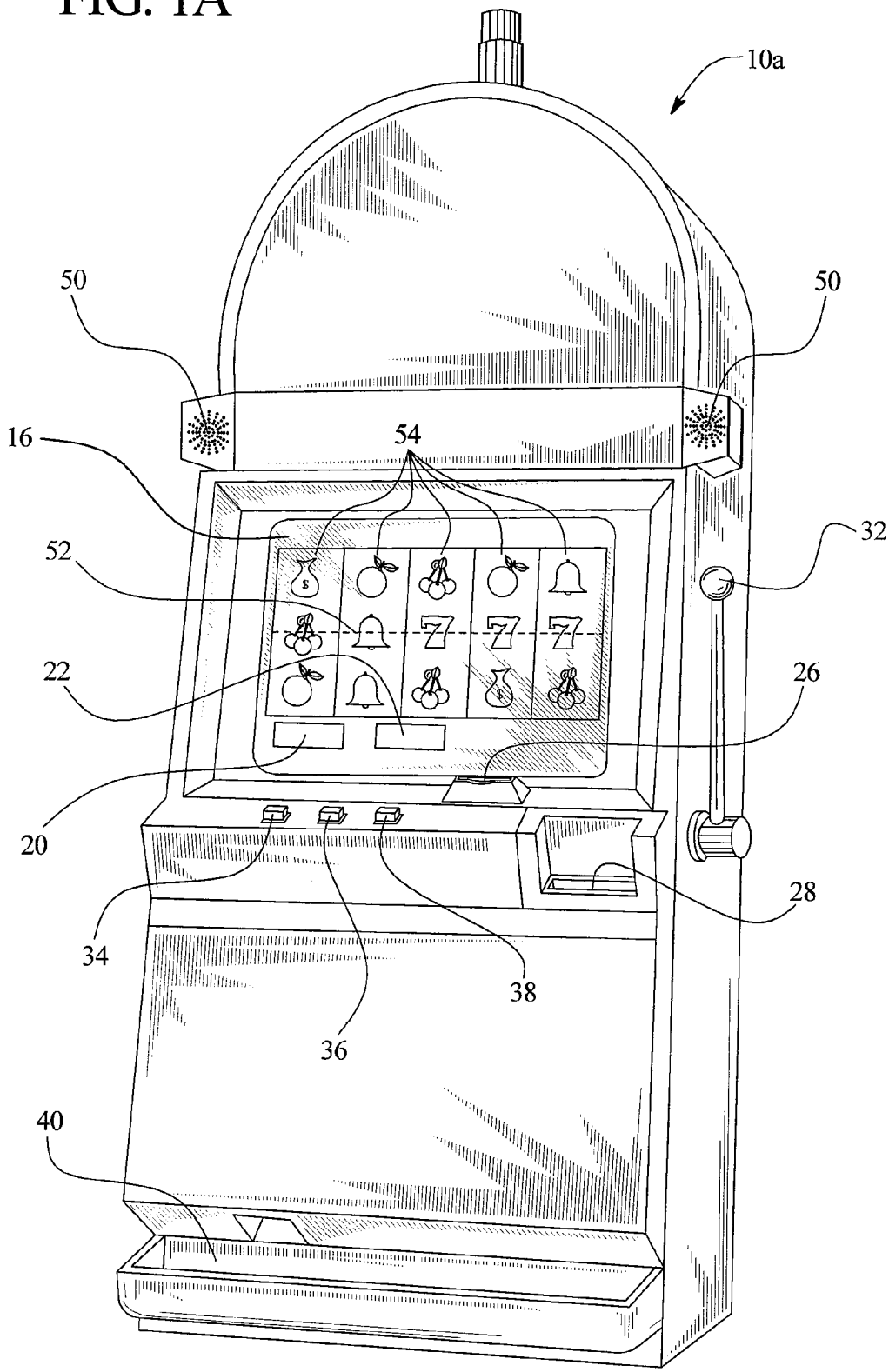
FIGS. 1A and 1B are front perspective views of various embodiments of a slot machine embodiment of the gaming device of the present invention.
Figure 1B:
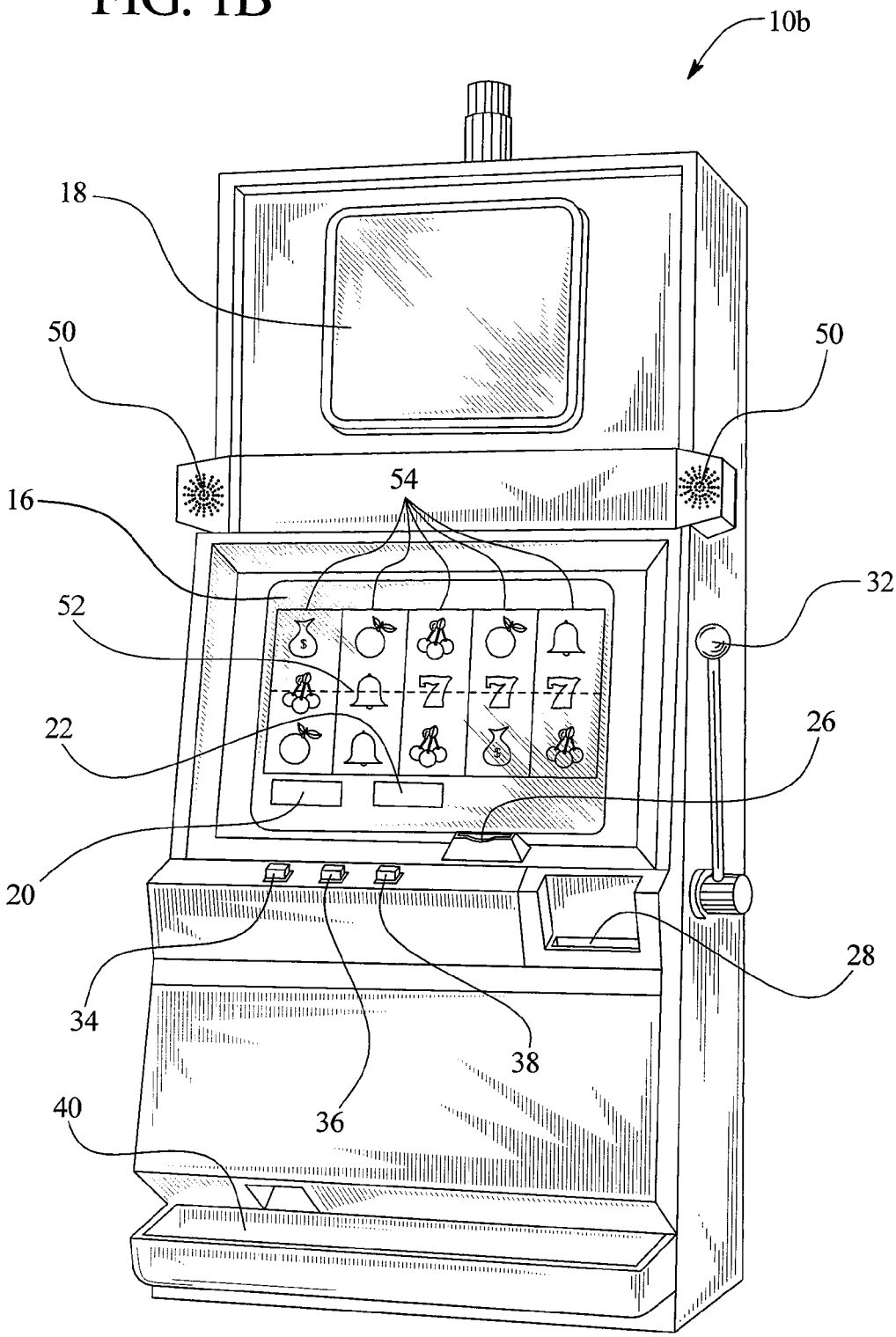

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 2A:
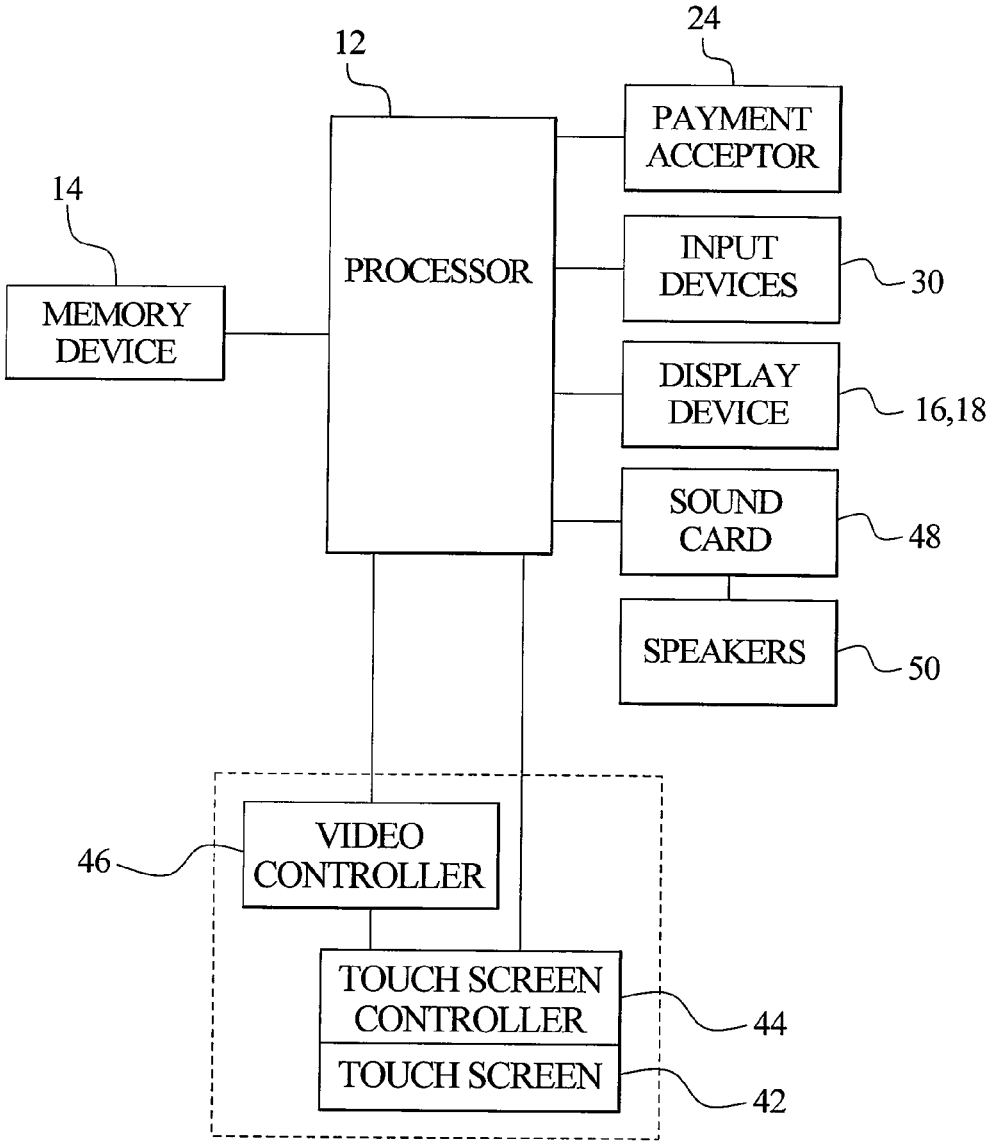
FIG. 2A is a schematic block diagram of the electronic configuration of one embodiment of the gaming device of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or other operating data, information and applicable game rules that relate to the play of the gaming device. In another embodiment, the memory device includes random access memory (RAM). In one embodiment, the memory device includes read only memory (ROM). In a further embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. In this type of embodiment, the gaming device provides players with all of the available awards or other game outcomes over the course of the play cycle and guarantees a designated amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered.

The display devices may include, without limitation, a monitor, a television display, a plasma display, a liquid crystal display (LCD), a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, a rectangle or an elongated rectangle.

The display devices of the gaming device are configured to display at least one and preferably a plurality of games or other suitable images, symbols and indicia such as any visual representation or exhibition of the movement of objects such as mechanical, virtual or video reels and wheels, dynamic lighting, video images and images of people, characters, places, things and faces of cards, tournament advertisements, promotions and the like.

In one alternative embodiment, the symbols, images and indicia displayed on or by the display device may be in mechanical form. That is, the display device may include any suitable electromechanical device which preferable moves one or more mechanical objects, such as one or more mechanical rotatable wheels, reels or dice, configured to display at least one and preferably a plurality of games or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards, data cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game associated with the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips which are redeemable by a cashier or funded to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera, in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display device may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

The gaming device can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation of the game from a wager made by the player. That is, different primary wagering games, such as video poker games, video blackjack games, video keno, video bingo or any other suitable primary or base game may be implemented into the present invention.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device displays at least one reel and preferably a plurality of reels 54, such as three to five reels, in either electromechanical form with mechanical rotating reels or in video form with simulated reels and movement thereof. In one embodiment, an electromechanical slot machine includes a plurality of adjacent, rotatable wheels which may be combined and operably coupled with an electronic display of any suitable type. In another embodiment, if the reels are in video form, the plurality of simulated video reels are displayed on one or more of the display devices as described above. Each reel displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active pay line or otherwise occur in a winning combination or pattern.

In one embodiment, a base or primary game may be a poker game wherein the gaming device enables the player to play a conventional game of video poker and initially deals five cards, all face up, from a virtual deck of fifty-two cards. Cards may be dealt as in a traditional game of cards or in the case of the gaming device, the cards may be randomly selected from a predetermined number of cards. If the player wishes to draw, the player selects the cards to hold by using one or more input devices, such as pressing related hold buttons or touching a corresponding area on a touch-screen. After the player presses the deal button, the processor of the gaming device removes the unwanted or discarded cards from the display and deals replacement cards from the remaining cards in the deck. This results in a final five-card hand. The processor of the gaming device compares the final five-card hand to a payout table which utilizes conventional poker hand rankings to determine the winning hands. Award based on a winning hand and the credits wagered is provided to the player.

In another embodiment, the base or primary game may be a multi-hand version of video poker. In this embodiment, the player is dealt at least two hands of cards. In one such embodiment, the cards in all of the dealt hands are the same cards. In one embodiment each hand of cards is associated with its own deck of cards. The player chooses the cards to hold in a primary hand. The held cards in the primary hand are also held in the other hands of cards. The remaining non-held cards are removed from each displayed hand and replaced with randomly dealt cards. Since the replacement cards are randomly dealt independently for each hand, the replacement cards will usually be different for each hand. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one and preferably a plurality of the selectable indicia or numbers by using an input device or by using the touch-screen. The gaming device then displays a series of drawn numbers to determine an amount of matches, if any, between the player's selected numbers and the gaming device's drawn numbers. The player is provided an award, if any, based on the amount of determined matches.

In one embodiment, in addition to winning credits in a base or primary game, the gaming device may also give players the opportunity to win credits in a bonus or secondary game or bonus or secondary round. The bonus or secondary game enables the player to obtain a bonus prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program code which causes the processor to automatically begin a bonus round when the player has achieved a triggering event, a qualifying condition or other designated game event in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be triggered by exceeding a certain amount of game play (number of games, number of credits, amount of time), earning a specified number of points during game play or as a random award.

In one embodiment, once a player has qualified for a bonus game, the player may subsequently enhance their bonus game participation by returning to the base or primary game for continued play. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game. The player must win or earn entry through play of the primary game, thereby encouraging play of the primary game. In another embodiment, qualification of the bonus or secondary game could be accomplished through a simple "buy in" by the player if, for example, the player has been unsuccessful at qualifying for the bonus game through other specified activities.

Figure 2B:
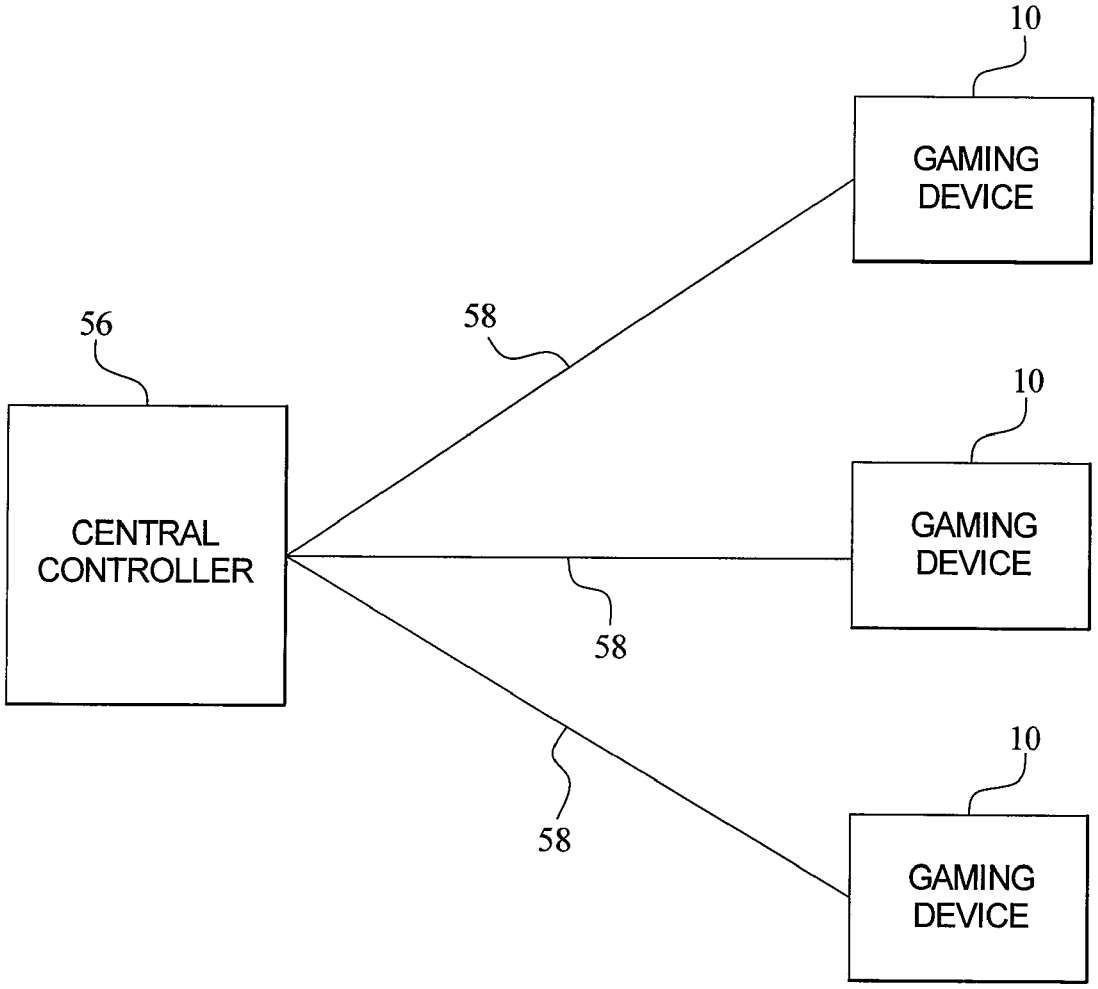
FIG. 2B is a schematic block diagram of various gaming devices employing the wagering game of the present invention, wherein the devices are networked to a central controller.

In one embodiment, as illustrated in FIG. 2B, one or more of the gaming devices 10 of the present invention may be connected to a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and/or preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or an on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected to a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server or webserver) through a conventional phone or other data transmission line, digital signal line (DSL), T-1 line, coaxial cable, fiber optic cable, wireless gateway or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

Game Play

Referring now to FIGS. 3 to 6, one example of the game of the present invention as seen by the player is displayed. FIGS. 3 to 6 show different times in the sequence of operation of the game on display. FIGS. 3 to 6 each show a grid labeled "categories". In one embodiment, the game operates in conjunction with the theme of the Jeopardy™ game show. The categories grid corresponds to the categories of answers displayed to the contestants playing the Jeopardy™ game. The grid includes a plurality of value levels 72*a* to 72*e* and a plurality of columns 74*a* to 74*f*, wherein the columns would correspond to different subject matter categories in the Jeopardy™ game. It should be appreciated that while the illustrated embodiment shows the present invention on a video display, one embodiment of the present invention employs a mechanical display that illuminates or otherwise indicates the value levels. In one video or mechanical embodiment, the gaming device can include a plurality of different grids wherein the different grids include different value levels or different values (such as single Jeopardy or Double Jeopardy in the illustrated embodiment).

In the illustrated embodiment, value levels 72*a* to 72*d* each include the same value in each column 74*a* to 74*f*. For example, each of the values of the different columns associated with value levels 72*a* is the value five. Likewise, each of the values of the columns 74*a* to 74*f* associated with the value level 72*d* includes the value fifty. The values associated with award level 72*e* on the other hand change for one or more of the columns 74*a* to 74*f*. The change in values provides variety to the game if the player is able to receive an offer having one or more values from the final value level 72*e*. It should be appreciated that each of the value levels could include the same values for each of the columns. Alternatively, one or more or all of the value levels could include different values for the different columns 74*a* to 74*f*. In that latter case, the range of values on the average value increases sequentially from level 72*a* to 72*d*.

FIGS. 3 to 6 each display three contestants 82, 84 and 86, which respectively correspond to indicia "A", "B" and "C" in the illustrated screens. Contestants 82, 84 and 86 are player selectable. In one embodiment, contestants 82, 84 and 86 are each areas of the display device 16 or 18 that operate in conjunction with touch screen 42 to send discrete inputs to processor 12 when touched by a player 90. In an alternative embodiment, one, or more or all of the contestant selections 82, 84 and 86 are electromechanical input devices 30 provided elsewhere on the cabinet of gaming device 10. The electromechanical inputs 30 also send discrete signals to processor 12, indicating a choice by player 90. Eventually, the player receives an award which is displayed in award meter 88.

It should be appreciated that in an alternative embodiment, the plurality of offers are provided to the player without the selection of the contestants.

Figure 3:
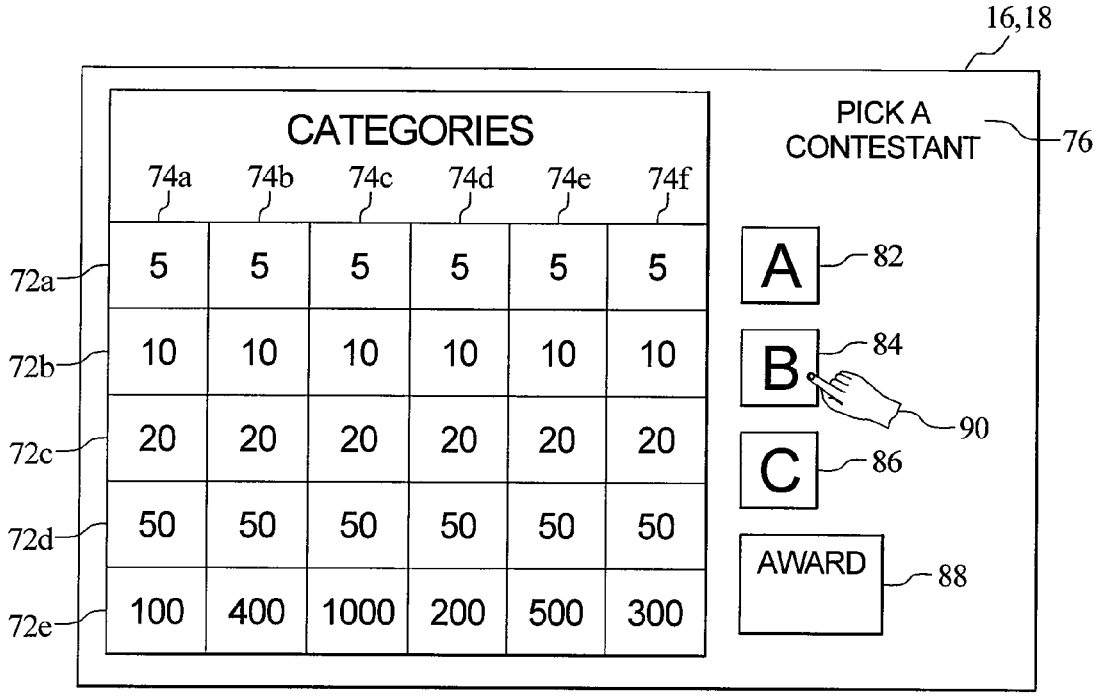
FIGS. 3, 4, 5 and 6 are elevation views of a display device illustrating one game sequence of the present invention.

In FIG. 3, gaming device 10 displays a message 76 to the player prompting the player to "pick a contestant". Player 90 in response picks the "B" selection 84.

Figure 4:
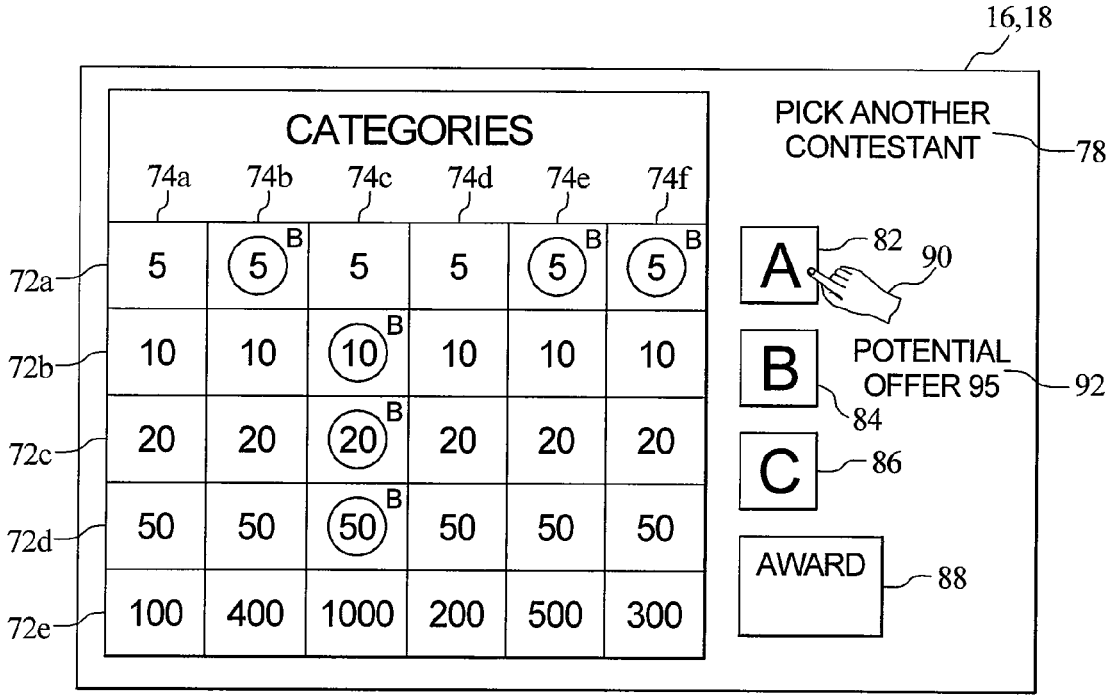

FIG. 4 shows the outcome of the pick by player 90 of selection 84 in FIG. 3. FIG. 4 shows that for the "B" selection, the player 90 receives a first potential offer of ninety-five, which is a combination of the values highlighted for selection "B". In particular, gaming device 10 has randomly generated the five values of award level 72*a* for the columns 74*b*, 74*e* and 74*f*. Gaming device 10 has randomly generated the value ten of value level 72*b* for the column 74*c*. Likewise, gaming device 10 has randomly generated the values twenty and fifty from award levels 72*c* and 72*d*, respectively, for the column 74*c*. Those values add to the potential offer of ninety-five, as displayed by offer message 92.

Gaming device 10 can use any suitable way to highlight the values associated with a player's pick of one of the contestants 82 to 86. In the illustrated embodiment, the values are circled. Alternatively, the values are illuminated, morphed, provided with a color change, any combination of those methods or via any other suitable method for highlighting certain values with respect to other values.

In one embodiment, the generation and display of the values associated with the "B" selection 84 is performed as much as possible in accordance with the theme of the Jeopardy™ game. That is, the values generated of the lowest value group are displayed first. Values picked from columns 74*a* to 74*f* are displayed sequentially from the previously selected values of the same columns. In one embodiment, a value may be displayed before a lower level value from another column is displayed. For example, in FIG. 4 each of the three values generated from level 72*a* is displayed before any of the higher values is displayed from column 74*c*. If the ten value of level 72*b* is instead generated from column 74*b*, and the five value from that column has already been generated, then that ten value can but does not have to be displayed before the five values of level 72*a* are displayed. The order in which multiple values within any given value level are displayed is randomly determined and does not need to follow any predetermined order, as is the case in the theme Jeopardy™ game.

The potential offer of 95 indicated by message 92 is not yet provided as an option to player 90 to keep. Accordingly, no value is displayed yet in award meter 88. In FIG. 4, gaming device 10 prompts the player to pick another contestant, as shown in audio, visual or audio-visual message 78. The player 90 accordingly picks the "A" contestant 82.

Figure 5:
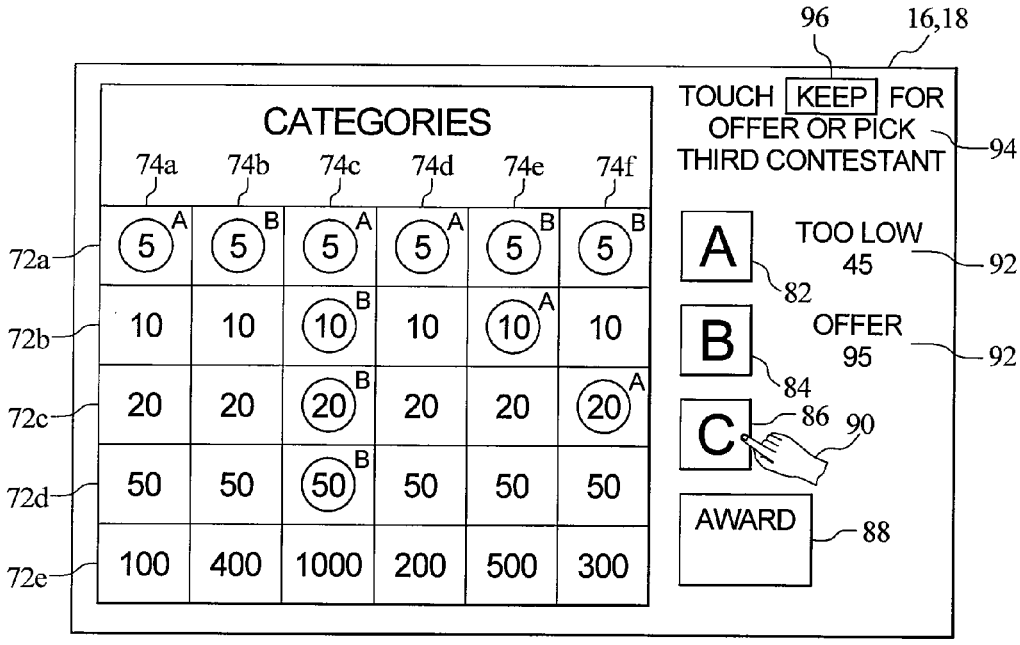

FIG. 5 illustrates the results of the player's pick of the "A" contestant 82. That is, gaming device 10 randomly generates and displays the five value from value level 72*a* in columns 74*a*, 74*c* and 74*d*. Gaming device 10 also displays, in association with the selection of the "A" contestant, the ten value from value level 72*b* in column 74*e* and the twenty value from level 72*c* in column 74*f*.

As discussed above, the value ten in column 74*e* could be highlighted before any of the five values in columns 74*a*, 74*c* and 74*d* because the five values of column 74*e* have been already highlighted via the "B" contestant 84. Thus for the second contestant "A" in accordance with the theme of the Jeopardy™ game, any of the five values or ten value for the letter "A" could be displayed first, second, third or fourth. The twenty value in column 74*f*, however, must be displayed last because the ten value in column 74*f* has not been previously highlighted. In keeping with the theme of the Jeopardy™ game, if for contestant "A" gaming device 10 had generated the one thousand value of column 74*c*, that value could have been displayed before any of the five values of value level 72*a* generated for contestant "A". This would be analogous to a player completing a category before switching to a different category in the theme Jeopardy™ game.

In FIG. 5, the game has not yet provided an award to the player, which would be indicated in award meter 88. The combination of values generated for the "A" contestant selection add to forty-five as indicated by offer message 92 for contestant "A" in FIG. 5. As further illustrated by offer message 92 of FIG. 5, gaming device 10 has provided the larger of the two value accumulations, i.e., the value ninety-five for contestant "B", to the player as an initial offer. Gaming device 10 provides an audio, visual or audio-visual message 94 to the player to keep the initial offer or to reject the offer and pick the third contestant.

The game of gaming device 10 as illustrated in FIG. 5 offers and provides the larger of the two potential offers to the player as an actual initial offer. The game then enables the player to either keep the initial actual offer or reject that offer for a final offer, wherein the final offer is then automatically provided to the player. It should be appreciated that while two potential offers are built in FIGS. 3 to 5, any suitable number of potential offers can be built, one of which being provided to the player as the player's actual initial offer or the highest of which is provided as discussed below.

FIG. 5 illustrates a keep selection 96, which the player presses to accept the offer of ninety-five. In an embodiment, ninety-five represents ninety-five gaming device credits. In alternative embodiments, ninety-five represents another type of value, such as a multiplier of gaming device credits, a number of picks from a prize pool, a number of free games, a number of free spins, a non-monetary award or other suitable award.

As illustrated in FIG. 5, player 90 rejects the offer of ninety-five to receive instead the final offer, which in this case is associated with the contestant 86. "C" contestant 86 is an area of display device 16, 18 operating with touch screen 42 in one embodiment. The "C" contestant 86 operates as reject initial offer input.

In one embodiment, the player's picks do not dictate the outcome of the generation of the outcomes. That is, if the player had instead chosen one of the "A" or "C" contestants first, the gaming device 10 would have generated the same values that it did in FIG. 4 for the "B" contestant. The random generations are associated with the order in which the player makes the pick as opposed to the actual contestant chosen. This method is also operable with the embodiments discussed in FIGS. 15 and 16, wherein an award level for one of the columns must be filled before the next highest award level is filled for that column. As illustrated by column 74*f* of FIG. 3, such is not necessarily the case in FIGS. 3 to 6.

In an alternative embodiment, the contestants are actually associated with the random generations. That is, the "A" selection, for example, has a set random generation that takes place regardless of the order in which the "A" contestant is selected.

Figure 6:
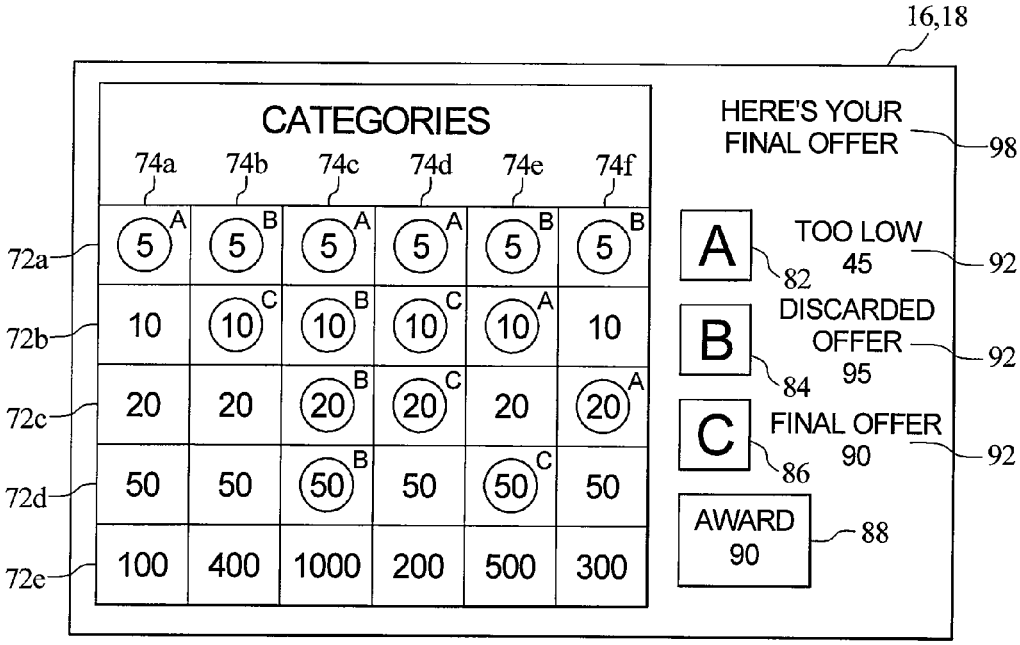

The player 90 opts to reject the offer of ninety-five and instead pick the final remaining "C" contestant 86. FIG. 6 illustrates the outcome of that pick. It should be noted that the entire first value level 72*a* is already filled and therefore that value is unavailable for the final generation. Gaming device 10 instead randomly generates the ten values of award level 72*b* for columns 74*b* and 74*d*. Gaming device 10 also generates the twenty value of award level 72*c* for column 74*d* and the value fifty for award level 72*d* of column 74*e*. Those values total ninety as illustrated by the offer message 92 for contestant "C" 86 as seen in FIG. 6.

A message 98 indicates to the player that the player receives as the final offer the value accumulation for the "C" contestant. The value 90 is then awarded to the player as seen in award meter 88. If the present invention is a bonus game, gaming device 10 returns the player to base game play after FIG. 6. If the game of gaming device 10 is instead itself a base game, the player has the option to wager more credits and play again or cash out from gaming device 10.

Placing the letters "A" to "C" adjacent to the values of the offers generated for those contestants provides a convenient method for illustrating the distinctions. It should be appreciated however that gaming device 10 can provide the separate value associations in other ways, such as via different colors, backgrounds or other visual markings.

FIGS. 3 to 6 provide a good introduction for the present invention because each of the embodiments herein includes a plurality of potential award offers, wherein a selected or highest one of the offers is provided to the player as an actual initial offer. The player can either keep or reject the initial offer for a final offer. In alternative embodiments, multiple offers could be provided as part of a final offer sequence, e.g., three of five contestants build three potential offers, the highest one of which is used in keep and trade sequences with actual offers for the final two of five contestants. As shown below, the present invention includes many variations both as to how the values that form the offers are selected and how they are displayed to be in accordance with the theme of the Jeopardy™ game show.

Figure 7:
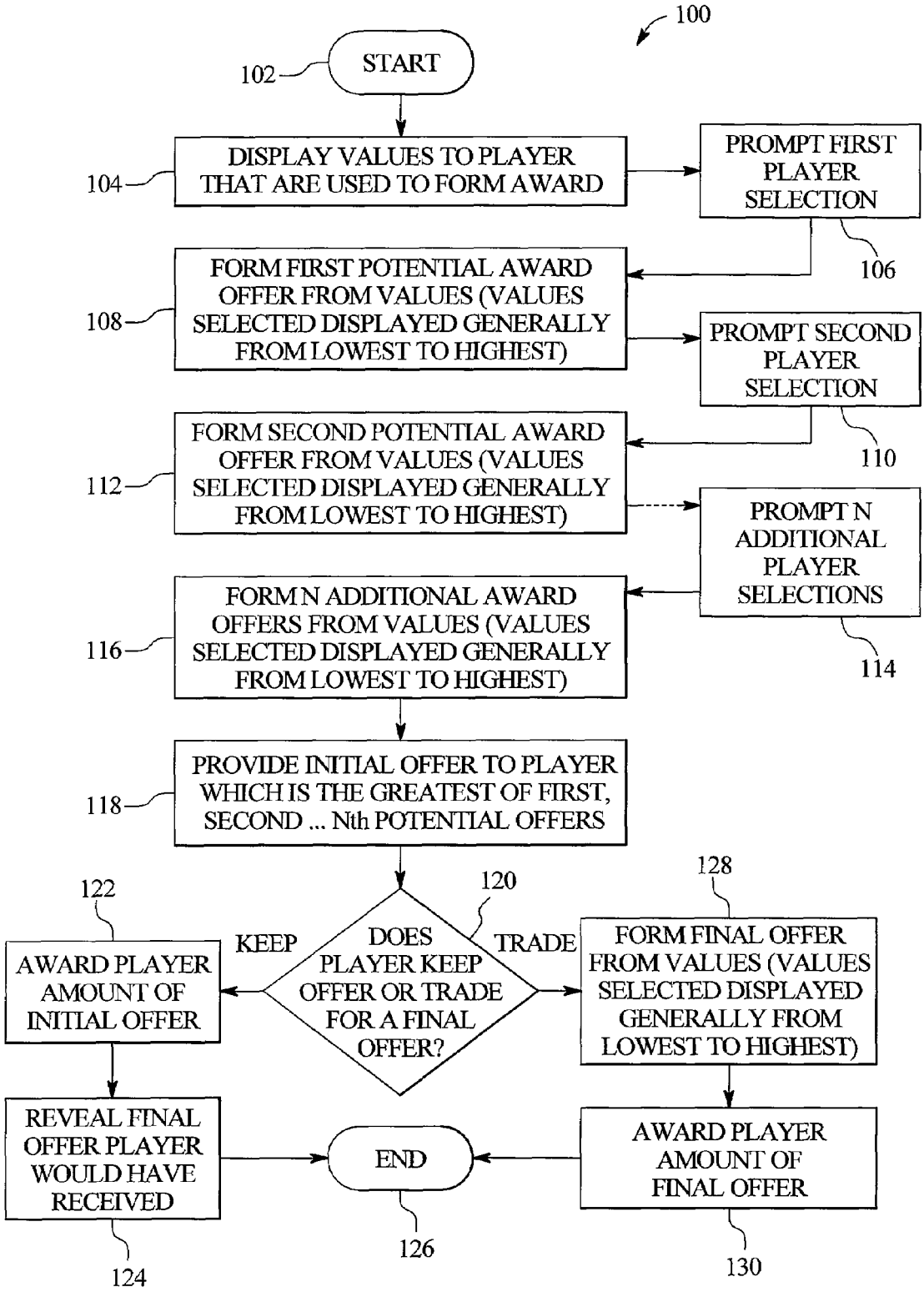
FIG. 7 is a schematic flow diagram that reiterates the method of operation set forth in FIGS. 3 to 6.

Referring now to FIG. 7, a method 100 illustrates in schematic form the process described previously in FIGS. 3 to 6. Upon starting the game as indicated by oval 102, gaming device 10 displays values to the player that are used to form an award, as indicated by block 104. The values correspond to the value levels and columns of values shown in FIGS. 3 to 6. In an alternative embodiment, the value levels do not have to be displayed in the grid-like format. Next, the player is prompted to make a first selection, as indicated by block 106. Gaming device 10 forms the first potential award offer from values generated in association with the first player selection, as indicated by block 108. In one preferred embodiment, the values are displayed generally from lowest to highest.

Then, gaming device 10 prompts the player to pick a second selection, as indicated by block 110. A second potential award offer is formed from values generated in association with the second selection as indicated by block 112. Again, in one embodiment, the values for the second selection are displayed generally from lowest to highest. The above process is repeated "N" number of times. Schematically, the gaming device is shown prompting the player to make "N" additional player selections as indicated by block 114. Additional potential award offers from values associated with those selections are formed and displayed generally in one embodiment from lowest to highest as indicated by block 116.

Gaming device 10 provides the player an initial offer, which in one embodiment, is the greatest of the first, second and "N" additional potential offers, as indicated by block 118. In other embodiments, the initial offer is generated randomly from the potential offers. The potential offers provided could also be based on the player's wager such as the highest potential offer provided if maximum bet made.

The player as illustrated in connection with FIG. 5 is provided an option to keep the initial offer or trade the initial offer for a final offer, as indicated by diamond 120. If the player keeps the initial offer as indicated by block 122, gaming device 10 awards the player the amount of the initial offer. In one embodiment, gaming device 10 reveals the final offer the player would have received if the player had decided to trade the initial offer instead of keeping that offer, as indicated by block 124. The reveal alternatively takes place before the award of the initial offer, i.e., before sequence of block 122. In any case, the game ends afterward as indicated by oval 126.

If the player decides instead to reject the offer and trade it for a final offer as indicated by diamond 120, gaming device 10 forms the final offer from the displayed values and, in an embodiment, displays those values generally from lowest to highest, as indicated by block 128. Gaming device 10 then awards the amount of the final offer to the player, as indicated by block 130 and the sequence of method 100 ends, as indicated by 126. As discussed above, the sequence indicated by block 128 alternatively includes multiple final offers built from displayed values.

Figure 8:
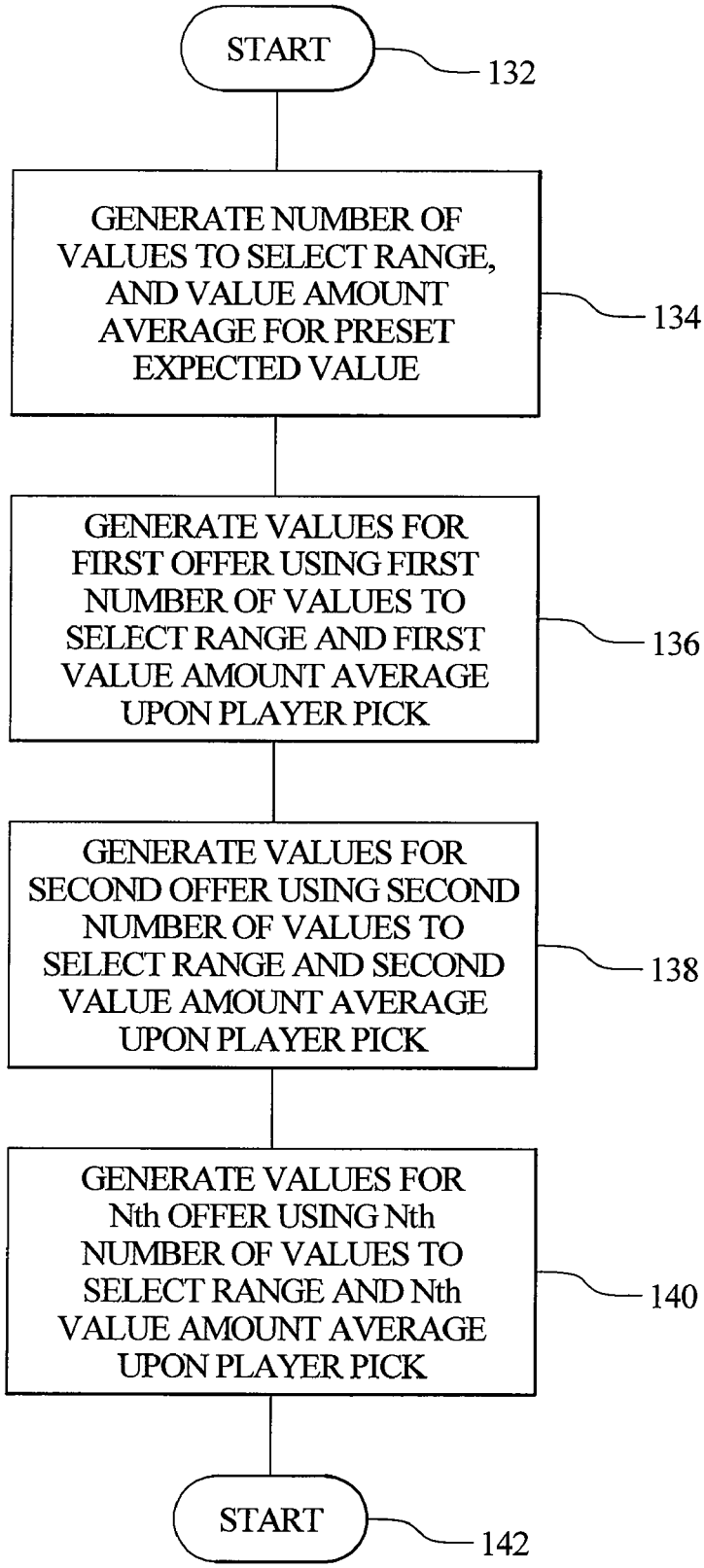
FIG. 8 is schematic flow diagram illustrating one embodiment for generating the displayed values used to form the offers/potential offers of the present invention.

Referring now to FIG. 8, one method for generating the values upon the player's selection of a contestant is illustrated. Upon starting the method as indicated by oval 132, gaming device 10 generates a number of values, as indicated by block 134. To do so, gaming device 10 uses a number of values to select ranges and value amount averages that are derived from a predefined expected value. Table 150 of FIG. 9 described in detail below shows one example of a set of data that can be used to generate the number of values to select ranges and the value amount averages. Generally, for a given expected value, certain entries will have a larger number of selected value ranges and a smaller average value, while other entries will have a lower range with higher expected value amounts. That is, certain picks of the contestants will generate more values, but the values will tend to be lower values. Other picks of the contestants will tend to generate less values, but the values will tend to have higher amounts.

Once the ranges are set as indicated in block 134, the gaming device, upon a player's selection of one of the contestants, generates values for a first offer/potential offer using a first number of values to select a range and a first value amount average as indicated by block 136. Next, upon a second player pick of one of the contestants, gaming device 10 generates values for a second offer (term "offer" also includes "potential offer" as those concepts have been described above) using a second number of values range and a second amount range. That process is continued as indicated by the dotted lines of method 100 of FIG. 7 until the game, upon a player pick of a contestant, generates values for the final or Nth offer using Nth number of values to select range and an Nth value amount average as indicated by block 40. After generating values for the Nth offer as indicated by block 140, the method ends as indicated by oval 142.

Referring now to FIGS. 9 to 12, a number of tables storing information in the memory device 14 of gaming device 10 are illustrated. As referenced above, table 150 of FIG. 9 illustrates the different ranges, averages and expected values for the player's picks of the contestants. As illustrated above, gaming device 10 in FIGS. 3 to 6 provides the player with three picks. Table 150 likewise corresponds to providing the player with three picks. In alternative embodiments, the player receives only two picks or a number of picks greater than three.

In one embodiment, the expected value for each pick is the same. If one expected value is significantly higher or lower than the rest of the expected values, the player who plays the game often may learn such a fact and constantly accept an offer provided from that pick. The average value amount is then the expected value divided by the average number of values.

For the first pick, gaming device 10 can select randomly to highlight or use for making the potential offer using from two to ten values. Assuming equal weight is applied to each entry, the average number of values for the first pick is six. For the first pick, the average value amount is nine since the present expected value is fifty-four. If the expected value changes, the average value amount also changes.

Picks two and three progressively lessen the average number of values and increase the average value amount. The second pick of table 150 yields a number of highlighted values from two to eight. That range, if weighted equally, produces an average number of values highlighted equal to five. Since the expected value is fifty-four, the average value amount is 10.8 as illustrated. For the third pick, the game generates anywhere from one to five values to highlight and form the final offer. The average number of values is three, yielding in cooperation with the expected value of fifty-four, an average value amount of eighteen. The numbers used in table 150 of FIG. 9 represent merely one example and are not intended to limit the scope of the present invention to the example shown.

Referring now to table 155 of FIG. 10, a weighted range of number of values to select is illustrated. In FIG. 9, the entries of the ranges are each to be equally weighted. In the table 155, the entries are weighted according to a bell curve so that the middle of the range tends to be selected slightly more than the near ends of the range, which in turn are selected slightly more than the distant ends of the range. In alternative embodiments, the weighting profile is distributed differently to achieve a desired variability for the offer/acceptance game of the present invention.

Referring now to FIG. 11, a table 160 shows weighted values stored in memory 14. The values are similar to the values in the final or highest value level 72*e* of FIGS. 3 to 6. In table 160, however, the values are weighted so that the lowest value one hundred is more likely to be selected than the highest value five hundred. It should be appreciated that weighted and variable value levels can be provided as a first or intermediate value level and are not limited to being the final value level.

Referring now to FIG. 12, a table 165 stored in memory 14 shows weighted award levels. In one embodiment of the present invention, the gaming device selects values from different levels according to a weight assigned to the levels. In the table 165, Level 1 is chosen five times as often as Level 3, and twenty-five times as often as Level 5. Level 2 is chosen three times as often as Level 3 and fifteen times as often as Level 5. When using the weighted levels of FIG. 12, the first pick through the last pick of the contestants can yield offers formed from the same number of values because the average value amount per highlighted value is the same for each pick. That is, the table 165 sets a constant average value amount via the weighted value levels, but excludes previously selected amounts so you get fewer picks in later rounds.

Figure 13:
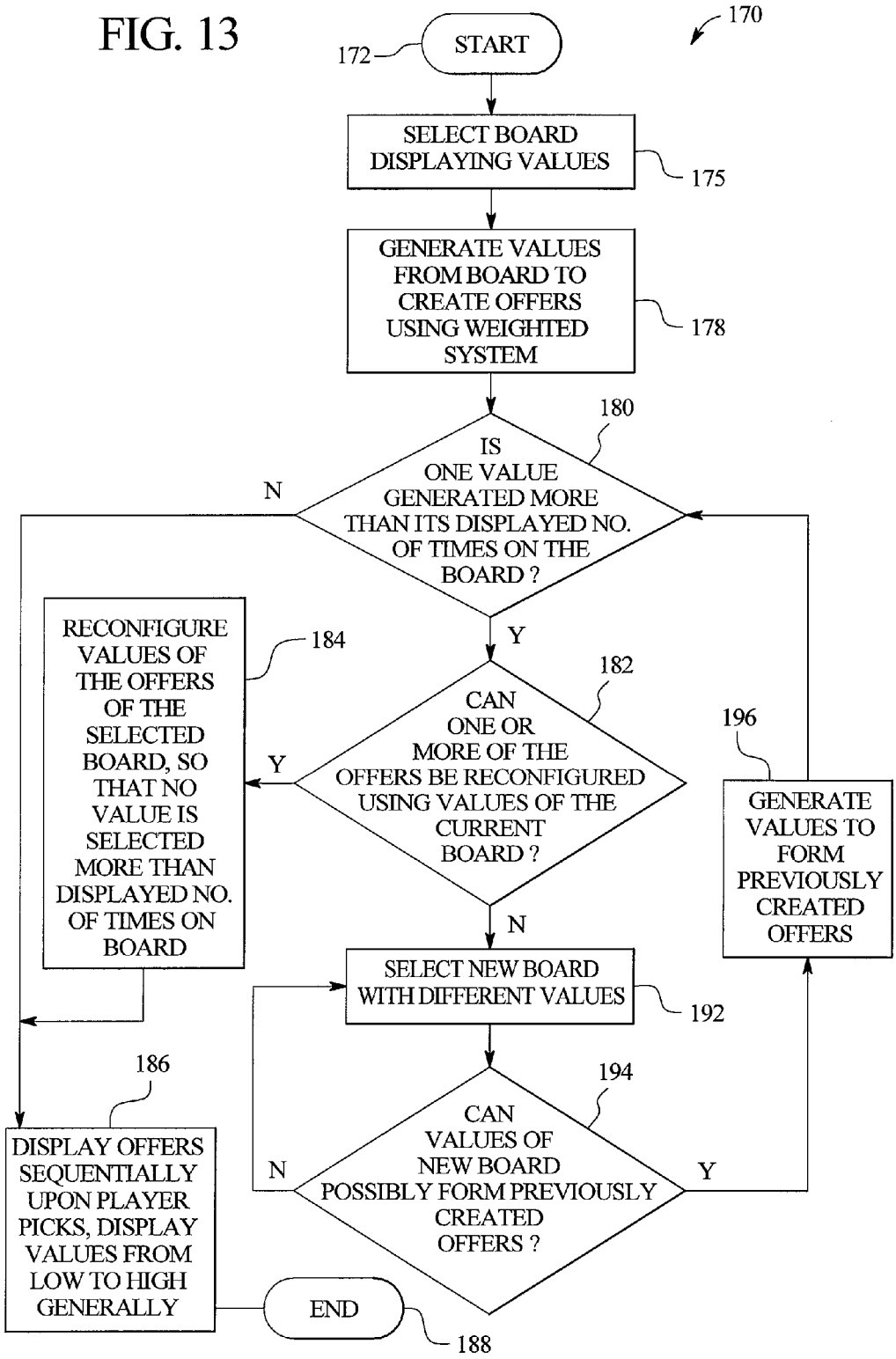
FIGS. 13 and 14 are schematic flow diagrams illustrating various methods for reconfiguring a value generation if all available values of a certain generated value has been previously generated.
Figure 14:
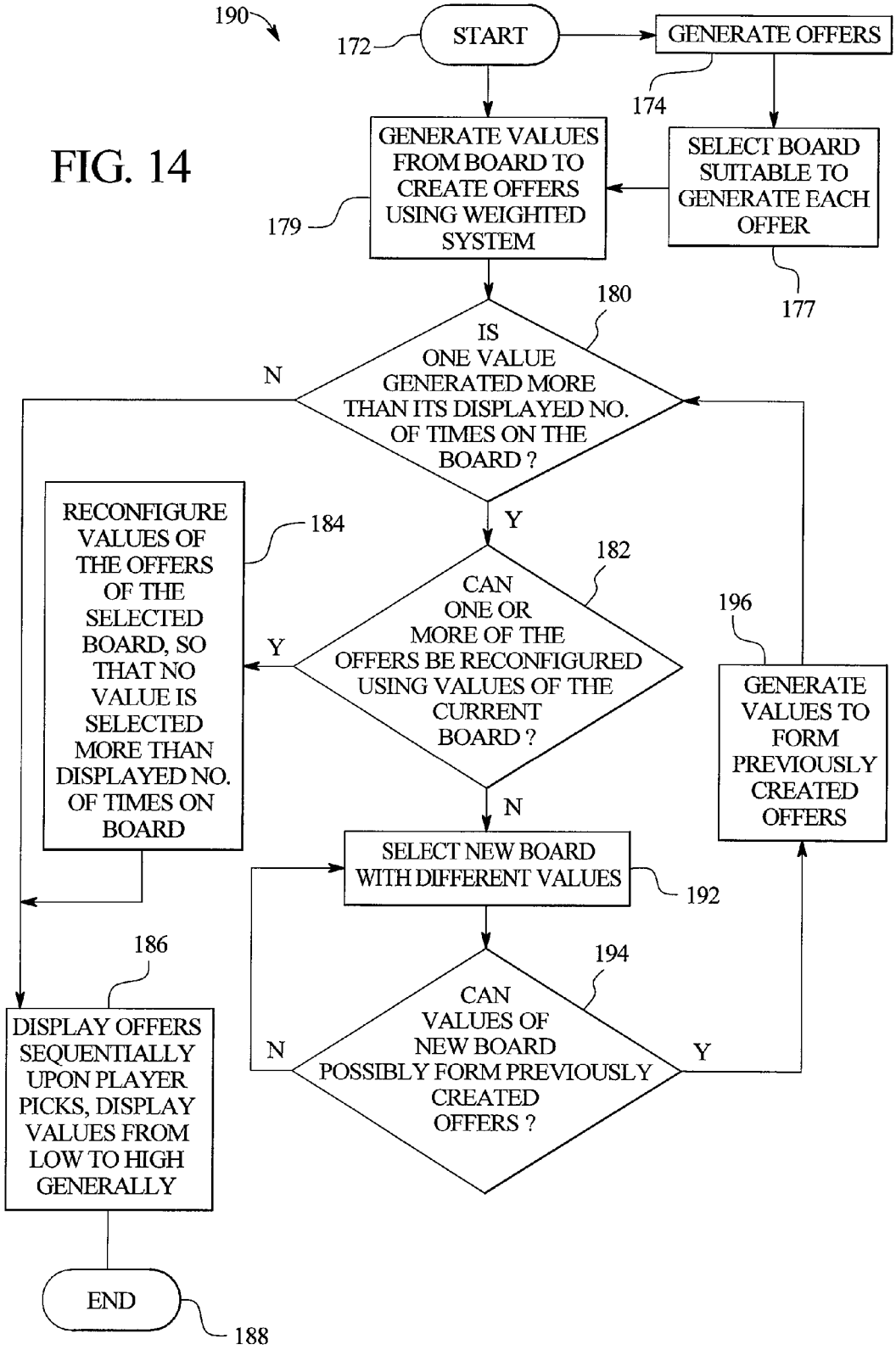

Referring now to FIGS. 13 and 14, two flow diagrams 170 and 190 show different methods for reconfiguring the values of the offers if one or more of the values is generated but no longer available. For example, viewing FIGS. 3 to 6, the "five" values of the lowest value level 72*a* were all highlighted or used by the time the final offer was generated. If in determining values for the final offer the value five would have been generated again, the game presumably would have no way to reconcile the fact that the "five" values had all previously been taken. The methods of FIGS. 13 and 14 remedy that situation.

Method 190 is very similar to method 170 except that in the method 190 the offers/potential offers are generated up front. The offers/potential offers in FIGS. 3 to 6 appear to be an accumulation of different values. In one embodiment, the offers are a combination of various values. In that embodiment, gaming device 10 generates values and not offers. In method 190 of FIG. 14 on the other hand, gaming device 10 generates offers and then selects values to add to those generated offers. Both embodiments are random and neither produces a discernable effect for the player. The method 190 on the other hand may be desirable from the standpoint that an offer can be generated from a central determination type of system described above, which controls a payout. That is, the offers are randomly predetermined, downloaded to gaming device 10 and used in the offer/acceptance game of the present invention.

Upon starting method 170 of FIG. 13 as indicated by oval 172, gaming device 10 selects a board or a grid displaying the values of the value levels as indicated by 175. Method 190 of FIG. 14 operates similarly except that gaming device 10 generates offers as indicated by block 174 and selects a board or grid having value levels with values suitable to generate each of the offers, as indicated by block 177. That is, for example, while the values of value levels 72*a* through 72*e* of FIGS. 3 to 6 are suitable to generate any award ending in zero or five, the values could not accumulate to generate an offer that ends in one, two, three or four. In method 190, however, the values are selected to insure that each offer is possible.

In the method 170 of FIG. 13, gaming device 10 generates values from the board to create offers using at least one of the weighted systems of FIGS. 9 to 12, as indicated by block 178. The weighted system of FIG. 9 could be used or the weighted value levels of FIG. 12 could be used. The weighted number value range of FIG. 10 could additionally be employed with one or more ranges of FIG. 9, in accordance with the constant expected value preference. The weighted awards of FIG. 11 could be used with either weighting systems of FIG. 9 and FIG. 12.

In method 190 of FIG. 14, values are generated from the board to equal the generated offers using one or more of the weighted systems of FIGS. 9 to 12, as described above. After the blocks 178 and 179 of FIGS. 13 and 14, respectively, the methods are the same and are numbered as such.

Gaming device 10 can determine if one of the values has been generated more than its displayed number of times on the board or grid. For example, in FIGS. 3 to 6, gaming device 10 determines whether any of the values five, ten, twenty or fifty has been generated more than six times. That determination is made in connection with diamond 180. If no value is generated more than its displayed number of times, the plurality of offers are displayed sequentially after the player's picks, in one embodiment, generally from lowest to highest, as illustrated by block 186. The game proceeds as above and eventually ends as indicated by oval 188.

If one of the values is generated more than its displayed number of times on the board or grid, as determined in connection with diamond 180, gaming device 10 determines whether one or more of the offers can be reconfigured using the values of the current board or grid, as indicated by diamond 182. If so, then gaming device 10 reconfigures the values of the offers of the previously selected board, so that no value is selected more than its displayed number of times on the board, as indicated by block 184. The game proceeds to display the offers and play in accordance with the previously described figures, as indicated by block 186.

If the current board or grid cannot be reconfigured using the values of the current board, as indicated by diamond 182, gaming device 10 selects a new board with different values, as indicated by block 192. For example, if all the "five" values are used up and gaming device 10 thereafter generates two "five" values for one of the offers, gaming device 10 can then instead display a single ten value instead of the two "five" values, as indicated by block 184. On the other hand, if all of the five values are used up and the gaming device 10 generates only a single five value for the final offer, the grid, for example, of FIGS. 3 to 6 would have no way to accommodate that generation. Instead, a new board could be selected as indicated by block 192, wherein, for example, if the previous board had a five and a twenty, the new board could have a twenty-five value that would be highlighted instead of the five and twenty.

After generating a new board with different values, a determination must be made whether the values of the new board could possibly form the previously generated offers, as indicated by diamond 194. This step is similar to selecting a suitable board in the first place after the offers are pre-generated in method 190, as indicated by block 177. If the board cannot possibly generate the offers, then a new board is selected, as indicated by block 192. The loop between block 192 and diamond 194 is repeated until a suitable board is selected that can possibly generate each of the offers.

After a suitable board is generated, as indicated by diamond 194, the gaming device generates values to form the previously created offers, as indicated by block 196. Afterwards, the entire loop created after diamond 180 is repeated until either the offers can each be built together from values of a single board or grid initially, as indicated by block 186, or upon reconfiguration, as indicated by block 184. The ending of methods 170, 190 as indicated by oval 188 leads to the end of the play of the game, which in turn leads to the player resuming base game play or reinserting money if the methods described herein are base game methods.

Figure 15:
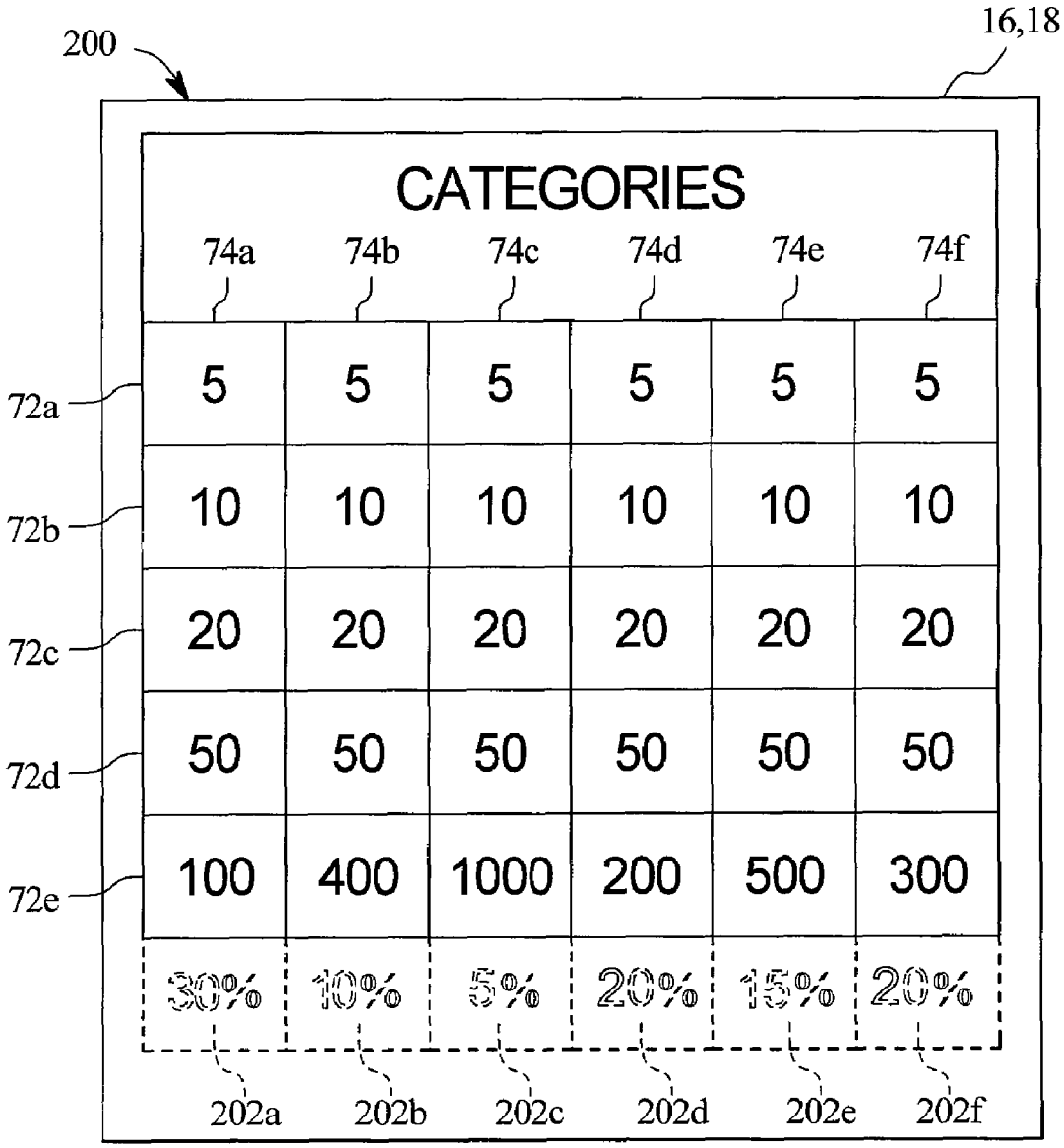
FIG. 15 is an elevation view of one embodiment of the present invention for generating the values in accordance with a theme of the game.
Figure 16:
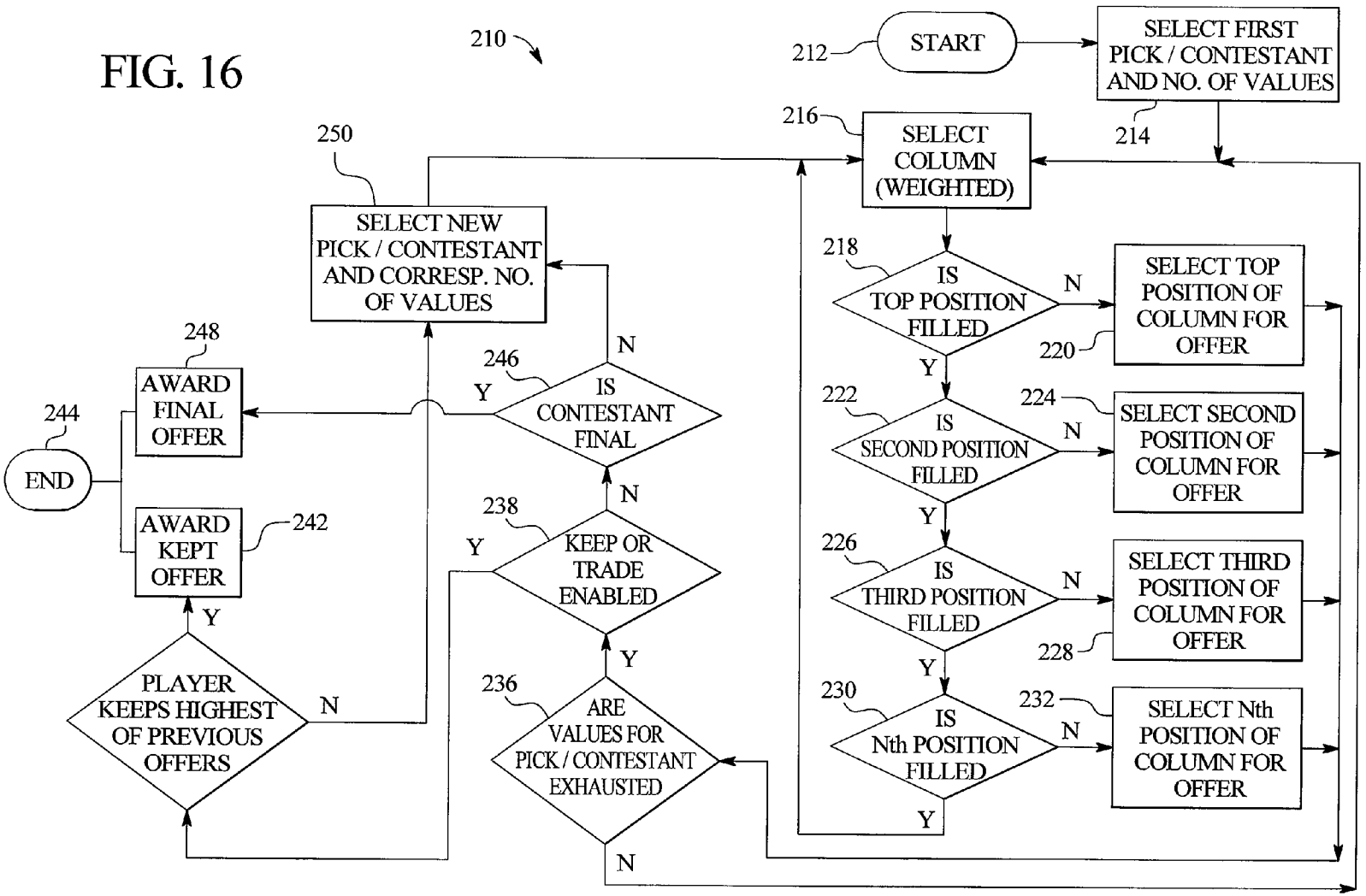
FIG. 16 is a flow diagram of the embodiment of the present invention of FIG. 15.

Referring now to FIGS. 15 and 16, one apparatus and method of the present invention is illustrated. The apparatus and method is advantageous because it eliminates the possibility of selecting values for the two or more different award offers, wherein the total number of any one of the displayed values is exceeded.

FIG. 15 illustrates a board or grid 200 showing different categories, which would be played in accordance with the Jeopardy™ game theme of the present invention. Grid 200 includes the same columns 74*a* to 74*f* and value levels 72*a* to 72*e* described above in connection with FIGS. 3 to 6. Grid 200 can be displayed, for example, on video monitors 16, 18. Each of the columns is also associated with a percentage 202*a* through 202*f*, respectively. The percentages apply a weight that any particular column is generated randomly. It should be appreciated that while percentages are used in one embodiment, each column could alternatively have the same percentage, i.e., be weighted equally. In the illustrated embodiment, the percentages are used so that it is more difficult to fill up the column 74*c*, which leads to the ultimate value of one thousand than it is to fill up the column 74*a*, which leads ultimately to the value one hundred.

Referring now to FIG. 16, a method 210 illustrates one embodiment of an alternative method, which employs the grid 200 of FIG. 15. Upon starting the method as indicated by oval 212, a player selects a first contestant and a number of values associated with that contestant or pick, as indicated by block 214. Next, one of the columns, e.g., a weighted column, is generated randomly, as indicated by block 216. If the first or top position (corresponding to value level 72*a*) is not filled, the top position of the selected column is highlighted or selected for the pick or contestant as indicated by block 220 and therefore can no longer be selected. If the top position is filled, then gaming device 10 determines in connection with diamond 222 whether the second highest position is filled (e.g., corresponding to award level 72*b*). If not, the offer built for the first pick is incremented by the second value position of the selected column, as indicated by block 224.

If the second position is filled as indicated by diamond 222, gaming device 10 determines whether the third position of the selected column is filled (e.g., corresponding to award level 72*c*, as indicated by diamond 226. If not, the third value from the selected column is added to the current offer, as indicated by block 228. If the third position has already been filled, as indicated by diamond 226, gaming device 10 determines whether the Nth or last position is filled, as indicated by diamond 230. If the Nth or last position has not been filled, gaming device 10 provides as part of the offer the value of the Nth position of the selected column. Method 210 therefore allows for the columns to contain any same or different number of values.

If the Nth position is filled, the Nth being the last position, then the game returns to select a new column because each of the columns is filled, as indicated by block 216. The loop created by block 216 and diamond 230 is repeated until a value is added to the current offer.

Once the offer associated with the pick or contestant is incremented, i.e., after blocks 220, 224, 228 and 232, gaming device 10 determines whether the values for the contestant are exhausted, as indicated by diamond 236. If not, game play returns to select a new column for the first contestant, as indicated by block 216. The loop created between block 216 and diamond 236 is therefore repeated until the values for the current contestant, pick or offer are exhausted, as indicated by block 236.

Once the values for a particular pick or contestant are exhausted, gaming device 10 determines whether the keep or trade option is enabled, as indicated by block 238. If the keep or trade option is enabled as indicated by diamond 238, then according to one embodiment the game described above, the current contestant is the next to last pick or contestant (in alternative embodiment keep or trade sequences takes place multiple times with multiple offers). Accordingly, the player is provided an option of keeping the highest of the previous offers, which are each value accumulations, as indicated by diamond 240. If the player decides to keep the initial offer, gaming device 10 awards the initial offer to the player as indicated by block 242 and the sequence ends as indicated by oval 244.

If the keep or trade option is not enabled, as indicated by diamond 238, a determination must be made whether the current contestant is the final contestant, as indicated by diamond 246. If the contestant or pick is the final contestant or pick, gaming device 10 awards the final offer to the player as indicated by block 248 and the sequence ends as indicated oval 244.

If the contestant is not the final contestant, as indicated by diamond 246 or if the player rejects the initially provided offer, as indicated by diamond 240, at least one pick or contestant remains and therefore a new contestant is picked, as indicated by block 250. A number of displayed or associated values for the pick or contestant is also generated as indicated by block 250. The game then returns to the select column stage, as indicated by block 216, and the sequence is repeated until one of the offers is eventually awarded to the player as indicated by either block 242 or block 248.

The apparatus and method of FIGS. 15 and 16 enables each of the columns to fill or partially fill incrementally. The offers build incrementally using values that add to an offer. The method also matches the sequence of operation of the Jeopardy™ game show theme.

Referring now to FIGS. 17 to 24, one alternative embodiment for structuring the selection of values for the different contestants is illustrated via the grid 300. The method of selecting values for the different contestants enables the display to appear very much like the actual game of Jeopardy™. The selection method does not allow for values to be used up prematurely or for lower values in certain columns to be selected after higher values in those columns. The method and apparatus also enables the different contestants to pick beginning from different value levels, but wherein the expected value for each contestant is approximately same in one embodiment, which is desirable.

FIG. 17 illustrates the sequence for the first contestant. Grid 300 in FIG. 17 is shown as being in an area of memory in memory device 14. That is, grid 300 as shown in FIG. 17 is not displayed to the player, rather, grid 300 determines the values and the positions of those values that are eventually displayed to the player. Following the example described above in connection with FIGS. 3 to 6, the first contestant is shown as Contestant "B". The selection of the values is shown and described going from left to right. It should be appreciated however that in one embodiment the selections are made prior to the actual play of the game by the player. The display of the selections from the different columns 74*a* to 74*f* can therefore be displayed randomly or otherwise, in accordance with the game show, and not from left to right. For purposes and ease of illustration, the description of the selection method is beginning with column 74*a* and ending 74*f*.

Each of the award levels 72*a* to 72*e* shown above is also illustrated in FIGS. 17 to 24. FIGS. 17 to 24 include an additional award level 72*f*. Each of the award levels includes a likelihood of generation percentage, which in combination with the value associated with the values levels 72*a* to 72*f* at least tends to make each contestant have approximately the same expected value. In short, the values of the levels increase from level 72*a* to level 72*f*. The likelihood of generation percentages decrease from level 72*a* to level 72*f*. The one exception illustrated is the likelihood of generation percentage associated with award level 72*f*, which increases from 10 percent in level 72*e* to 40 percent. It should be appreciated that those of skill in the art can calculate and set the likelihood of generation percentages and the values associated with the award levels to achieve a desired and entertaining award display and appropriate pay tables.

The value selection for Contestant "B" is shown in FIG. 17. The selection process begins in column 74*a* and at the award 72*a*. Here, the likelihood of generating a hit is fifty percent and the associated value is five. As illustrated, gaming device 10 randomly generates a hit for Contestant "B" at column 74*a*, award level 72*a*. The selection following a hit proceeds to the next highest award level in the same column, which has a value of ten but only a forty percent chance of generation. Here, gaming device 10 generates randomly a miss for Contestant "B".

It should be appreciated that each of the contestants selects in each of the columns until exhausting a column or generating a miss in that column. Accordingly, selection after the miss in column 74*e* turns to column 74*b*, beginning at value level 72*a*. Here, gaming device 10 generates randomly a hit for Contestant "B". Gaming device 10 generates randomly another hit in column 74*b* at award level 72*b*. In award level 72*c*, the likelihood of generation percentage falls to 30 percent, while the value increases to 20. Here, gaming device 10 generates randomly a miss for Contestant "B". Likewise, gaming device 10 generates a miss for Contestant "B" in the first value level 72*a* of column 74*c*.

Gaming device 10 generates randomly four hits in column 74*d* beginning with award level 72*a* and proceeding to award level 72*d*. Gaming device 10 finally generates a miss in column 74*d* when the likelihood of generation percentage is only ten percent for award level 72*e*.

Value selection then turns to column 74*e* at the award level 72*a*, where gaming device 10 generates randomly a miss for the player. Value selection turns then to the final column 74*f*, where gaming device 10 randomly generates a hit in award 72*a* and a miss for award level 72*b*. If the total value generated by the gaming device for any contestant is equal to zero, value selection can return to column 74*a* and the process begins again at the lowest possible selection value.

The total for Contestant "B" is shown at the bottom of FIG. 17 as one hundred ten credits. Following the method of generating two potential offers and the example of FIGS. 3 to 6 described above, the game then turns to making selections for Contestant "A" as shown in FIG. 18.

Referring to FIG. 18, each of the hits for Contestant "B" remains displayed. The selection for grid 300 in memory device 14 returns to column 74*a* and begins at the next available selection level, illustrated in FIG. 18, as award level 72*b*. For Contestant "A", gaming device 10 generates randomly a hit in value level 72*b* and column 74*a* but generates a miss in value level 72*c*. Value selection then moves to column 74*b*, where gaming device 10 generates randomly hits at value levels 72*c* to 72*e* and finally generates a miss at the final and highest value level 72*f*.

Gaming device 10 generates randomly a miss for Contestant "A" in column 74*c* at value 72*a* and then proceeds to generate another miss at column 74*d*, value level 72*e*. Gaming device 10 next generates randomly a hit for Contestant "A" at column 74*e* and value level 72*a*, followed by a miss by value level 72*b*. In column 72*f*, selection begins at value level 72*b*, where gaming device 10 generates randomly a hit for the player, followed by a miss generated at value level 72*c* for column 74*f*.

The bottom of FIG. 18 shows that the total for Contestant "B" is one hundred ten and the total for Contestant "A" is one hundred ninety-five. As discussed above, gaming device 10 takes the higher of the two contestant totals and makes that total as an offer to the player. The player can then keep the one hundred ninety-five credits or trade that offer for a chance at receiving the total of values associated with the final Contestant "C".

Following the above example of FIGS. 3 to 6, the player selects to forego the offer of one hundred ninety and generate instead values for Contestant "C". That decision leads to the selection grid 300 in memory device 14 for Contestant "C" in FIG. 19. Selection again returns to the first column 74*a* and begins at the lowest possible value level, which in the illustrated case is value level 72*c*. Here, gaming device 10 randomly generates a miss for Contestant "C".

Value selection next returns to column 74*b*, which has only one remaining value, the highest value of five hundred in value level 72*f*. The likelihood of generation percentage also rises from ten percent in value level 72*e* to forty percent in value level 72*f*. Gaming device 10 generates randomly a hit for the contestant in column 74*b* and at award level 74*f*. Because there is no remaining value levels in column 74*b*, selection turns to column 74*c*. The player hits again in column 74*c* at the beginning value level 72*a* and then misses at value level 72*b*. The contestant also misses in the first possible award level 72*e* of column 74*d*.

Selection turns then to column 74*e*, where the contestant hits at value level 72*b* and then misses at value level 72*c*. Selection for Contestant "C" reaches column 74*f*, where gaming device 10 generates randomly a miss for the contestant at the first available award level 72*c*. The bottom of FIG. 19 illustrates that the rejected offer is one hundred ninety but that Contestant "C" has obtained a total value of five hundred fifteen.

Referring now to FIG. 20, the hits for each of the Contestants "A" to "C" are shown to the player on display device 16 or 18. A similar screen is presented to the player illustrating the hits for Contestant "A" and again for the additional hits for Contestant "B". In each case, hits from different columns are displayed randomly and not in left to right format. The player's award of five hundred fifteen credits is also shown.

Referring now to FIG. 21, another feature of the embodiment illustrated in FIGS. 21 to 24 is that the game guarantees that each contestant obtains at least two hits. FIG. 21 is in one aspect therefore a recreation in memory device 14 of the final generation of selections for Contestant "C" shown in FIG. 19. Instead of obtaining the five hundred fifteen value, the game randomly generates misses for Contestant "C" upon the first available selection in each of the columns 74*a*, 74*b* and 74*d* to 74*f*. Contestant "C" only hits on the five value of value level 72*a* in column 74*c*. Because gaming device 10 in the illustrated embodiment guarantees the player at least two values, gaming device 10 displays a message (shown on display device 16, 18) informing the player even though the Contestant "C"'s picks appear to have been exhausted, there is another opportunity.

Referring to FIG. 22, if one of the contestants receives less than two values in the initial selection from each of the columns 74*a* to 74*f*, gaming device 10 in memory device 16, 18 picks from the columns sequentially until generating the requisite number of values such as two. Importantly, if the game generates a hit for the player, for example, bringing the total hits to two, gaming device 10 in one embodiment continues picking until generating a miss. That is, gaming device 10 does not stop exactly at two hits or the threshold number of hits unless the next generation is a miss. In FIG. 22, gaming device 10 generates randomly a miss in column 74*a*, followed by a miss in column 74*b*, followed by a miss in column 74*c*, followed by a miss in column 74*d* and finally generates a hit for the player at value level 72*b* of column 74*e*. It is also important to note that the one hit that Contestant "C" did achieve in column 74*c* at value level 72*a* in FIG. 21 is carried over to the additional selection of FIG. 22. The "C" contestant finally obtains the second hit in value level 72*b* of column 74*e*.

Value selection is continued until gaming device 10 generates randomly a miss. The hits in value levels 72*c* and 72*d* of column 74*e* are therefore tallied additionally for Contestant "C". Contestant "C" misses main value level 72*e* of column 74*e*. If for some reason, the player picks successfully all the way through column 74*f*, gaming device 10 in one embodiment enables the player to pick again from column 74*a* and proceed until finally generating another miss. In an alternative embodiment, the picks can be done all the way through each column. It should also be appreciated that a minimum number of picks can be provided to the player.

FIG. 23 shows the player on display device 16, 18 the hits from the "A", "B" and "C" contestants for the example of FIGS. 21 and 22. Here, the player receives the total award for Contestant "C", which is eighty-five.

FIG. 24 illustrates another feature of the method of FIGS. 17 to 24. Here, the initial selection for the "B" contestant in memory device 14 results in enough hits that neither Contestant "A" nor Contestant "B" could match the total 2,075 credits accumulated for Contestant "B". In such a case, gaming device 10 automatically locks-up and provides the player the award for Contestant "B". That is, when the optimal play is guaranteed to be one of the initial contestants prior to the offer and acceptance option, gaming device 10 automatically provides the award for that contestant to the player and does not allow the player the opportunity to forego that award for the final contestant accumulation, which would have no opportunity to exceed the initial offer, e.g., the offer of 2,075 credits shown in FIG. 24.

As stated above, the examples of FIGS. 17 to 24 show a method of internal game selection and not the order in which hits are displayed to the player. That is, hits do not have to be and are preferably not displayed from left to right or from right to left. Hits are displayed randomly in the different columns. In one preferred embodiment, hits are displayed from top to bottom, e.g., from award levels 72*a* to award level 72*f*, in any given column. For example, in FIG. 17, Contestant "B" hits could be displayed in order 74*b*, 72*a*; 74*f*, 72*a*; 74*d*, 72*a*; 74*d*, 72*b*; 74*b*, 72*b*; 74*a*, 72*b*; 74*d*, 72*c* and finally 74*d*, 72*d*. Alternatively, those hits can be displayed in a totally scattered format with no left/right or high/low restriction.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A method of operating a gaming device, said method comprising:

(a) causing at least one display device to display a plurality of different value groups, each value group including a plurality of different displayed ranked values;

(b) for one of a plurality of the value groups, randomly determining, in order from lowest ranked value to highest ranked value in said value group, whether to include any of the ranked values in said value group as part of a first offer;

(c) if said determination is not to include one of said ranked values in said value group, repeating (b) to (c) for another of said plurality of the value groups;

(d) causing the at least one display device to display said first determined offer;

(e) receiving a signal representing an acceptance or rejection of said first determined offer;

(f) for one of a plurality of the value groups, randomly determining, in order from lowest ranked value not used to form the first offer to highest ranked value not used to form the first offer, whether to include any of the ranked values in said value group as part of a second offer;

(g) if said determination is not to include one of said ranked values in said value group, repeating (f) to (g) for another of said plurality of the value groups;

(h) causing the at least one display device to display said second determined offer;

(i) receiving a signal representing an acceptance or rejection of said second determined offer; and (j) providing any accepted offers.

2. The method of claim 1, wherein each ranked value is associated with a probability of being part of an offer.

3. The method of claim 1, which includes weighing a likelihood that at least one of the ranked values of at least one of the value groups is in one of the offers more often than at least one other ranked value from the same value group.

4. The method of claim 1, which includes forming at least two first offers, determining a greater of the at least two formed first offers and providing the determined greater of the at least two first offers to accept or reject.

5. The method of claim 1, which includes causing the at least one display device to randomly display whether ranked values in different value groups are included in one of the offers.

6. The method of claim 1, which includes arranging the value groups in a grid, wherein ranked values of a same relative ranking within their respective groups are arranged adjacently in the grid.

7. The method of claim 1, which includes for each of the value groups, randomly determining, in order from lowest ranked value to highest ranked value in said value group, whether to include any of the ranked values in said value group as part of the first offer.

8. The method of claim 1, which includes for each of the value groups, randomly determining, in order from lowest ranked value not used to form the first offer to highest ranked value not used to form the first offer, whether to include any of the ranked values in said value group as part of the second offer.

9. The method of claim 1, which is controlled through a data network.

10. The method of claim 9, wherein the data network includes an internet.

11. A method of operating a gaming device, said method comprising:

(a) determining and causing at least one display device to display a first award, said first award formed from a first quantity of first values, wherein the first quantity is greater than one;

(b) determining and causing the at least one display device to display a second award, said second award formed from a second quantity of second values, wherein the first quantity is, on average, greater than the second quantity, and the second values are, on average, greater than the first values;

(c) determining the greater of the first award and the second award;

(d) receiving a signal representing an acceptance or a rejection of the determined greater of the first award and the second award;

(e) if the determined greater of the first award and the second award is accepted, providing the accepted award; and (f) if the determined greater of the first award and the second award is rejected, causing the at least one display device to display a third award.

12. The method of claim 11, which includes selecting the quantity of values used to form the first award from a first range of quantities having a greater upper end than a second range of quantities employed to select the quantity of values used to form the second award.

13. The method of claim 12, which includes weighting at least one of the first and second ranges so that at least one quantity of values is selected more often than at least one other quantity of values.

14. The method of claim 11, which includes selecting the quantity of values used to form the second award from a first range of quantities having a greater upper end than a second range of quantities employed to select a quantity of values used to form the third award.

15. The method of claim 11, which includes randomly selecting the values from different groups of varying values, wherein the values of each of the groups are each taken in an order from lowest to highest, the values used to form the first award selected before selecting the values used to form the second award, which are selected before selecting any values used to form the third award.

16. The method of claim 15, which includes arranging the groups in a grid, wherein values of a same relative amount within their respective groups are arranged adjacently in the grid.

17. The method of claim 11, which includes causing the at least one display device to display a plurality of selections, wherein a first one of the selections picked initiates formation of the first award, a second one of the selections picked initiates formation of the second award, and a third one of the selections picked rejects the higher of the first and second award to instead accept the third award.

18. The method of claim 11, which is controlled through a data network.

19. The method of claim 18, wherein the data network includes an internet.

* * * * *